US012117237B2

(12) United States Patent
Kang et al.

(10) Patent No.: US 12,117,237 B2
(45) Date of Patent: Oct. 15, 2024

(54) REFRIGERATOR

(71) Applicant: LG Electronics Inc., Seoul (KR)

(72) Inventors: Chanuk Kang, Seoul (KR); Dongrim Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/511,246

(22) Filed: Nov. 16, 2023

(65) Prior Publication Data

US 2024/0093933 A1 Mar. 21, 2024

Related U.S. Application Data

(63) Continuation of application No. 17/990,097, filed on Nov. 18, 2022, now Pat. No. 11,859,901, which is a (Continued)

(30) Foreign Application Priority Data

Apr. 17, 2020 (KR) ..... 10-2020-0046631

(51) Int. Cl.
*F25D 29/00* (2006.01)
*F25D 23/02* (2006.01)
*F25D 27/00* (2006.01)

(52) U.S. Cl.
CPC ..... *F25D 29/005* (2013.01); *F25D 23/025* (2013.01); *F25D 23/028* (2013.01); (Continued)

(58) Field of Classification Search
CPC ..... F25D 29/005; F25D 27/005; F25D 2400/361; F25D 2400/40; F25D 23/025; (Continued)

(56) References Cited

U.S. PATENT DOCUMENTS 6,059,420 A 5/2000 Rogers
9,689,603 B2 * 6/2017 Roh ..... F25D 23/028
(Continued)

FOREIGN PATENT DOCUMENTS

CN 105339747 2/2016
EP 3252742 12/2017
(Continued)

OTHER PUBLICATIONS

Extended European Search Report in European Appln. No. 21168904.7, dated Sep. 14, 2021, 8 pages.

*Primary Examiner* — Hiwot E Tefera
(74) *Attorney, Agent, or Firm* — Fish & Richardson P.C.

(57) ABSTRACT

A refrigerator includes a cabinet and a door configured to open and close a storage space of the cabinet. The door includes an outer plate defining a plate opening, a door liner defining a liner opening, a panel assembly configured to shield the plate opening and the liner opening. The panel assembly includes a first display through which the inside thereof is visible, and a screen is output, a second display disposed at a position that is spaced apart from the first display, and a frame provided between the outer plate and the door liner. The frame includes a first mounting part that mounts the panel assembly, a second mounting part that mounts the second display, and a wire guide part that connects the first mounting part to the second mounting part and accommodates a wire connected to the second display.

20 Claims, 21 Drawing Sheets

Related U.S. Application Data continuation of application No. 17/234,036, filed on Apr. 19, 2021, now Pat. No. 11,604,023.

(52) U.S. Cl.
CPC ..... *F25D 27/005* (2013.01); *F25D 2201/14* (2013.01); *F25D 2400/18* (2013.01); *F25D 2400/361* (2013.01); *F25D 2400/40* (2013.01)

(58) Field of Classification Search
CPC ..... F25D 23/028; F25D 2201/14; F25D 2400/18; F25D 2400/36; F25D 27/00; F25D 23/02; F25D 2323/023
See application file for complete search history.

(56) References Cited

U.S. PATENT DOCUMENTS

| | | | | |
|---|---|---|---|---|
| 9,879,900 | B1 | 1/2018 | Ammerman et al. | |
| 2005/0284159 | A1 | 12/2005 | Kim | |
| 2010/0327720 | A1 | 12/2010 | Pae | |
| 2016/0061514 | A1 | 3/2016 | Seo et al. | |
| 2016/0178277 | A1* | 6/2016 | Park | H03K 17/962 345/173 |
| 2016/0188093 | A1 | 6/2016 | Kim et al. | |
| 2017/0059875 | A1 | 3/2017 | Seung et al. | |
| 2017/0191746 | A1 | 7/2017 | Seo | |
| 2017/0261248 | A1 | 9/2017 | Koo et al. | |
| 2017/0370636 | A1 | 12/2017 | Koo et al. | |
| 2018/0160824 | A1 | 6/2018 | Lee | |
| 2018/0164030 | A1 | 6/2018 | Lee | |
| 2018/0164031 | A1 | 6/2018 | Lee et al. | |
| 2018/0192791 | A1 | 7/2018 | Miller et al. | |
| 2018/0223589 | A1 | 8/2018 | Chubb et al. | |
| 2018/0274846 | A1 | 9/2018 | Kim et al. | |
| 2018/0274852 | A1 | 9/2018 | Kang et al. | |
| 2019/0017679 | A1 | 1/2019 | Choi et al. | |

FOREIGN PATENT DOCUMENTS

| | | | | |
|---|---|---|---|---|
| EP | 3575715 | 12/2019 | | |
| KR | 10-2018-0067391 | 6/2018 | | |
| WO | WO 2011149319 | 12/2011 | | |
| WO | WO-2017213466 A1 * | 12/2017 | | A47F 3/0434 |

* cited by examiner

REFRIGERATOR

CROSS-REFERENCE TO RELATED APPLICATION

The present application is a continuation of U.S. application Ser. No. 17/990,097, filed on Nov. 18, 2022, which is a continuation of U.S. application Ser. No. 17/234,036, filed on Apr. 19, 2021, now U.S. Pat. No. 11,604,023, which claims priority under 35 U.S.C. 119 and 35 U.S.C. 365 to Korean Patent Application No. 10-2020-0046631, filed on Apr. 17, 2020, the disclosures of which are hereby incorporated by reference in their entirety.

TECHNICAL FIELD

The present disclosure relates to a refrigerator.

BACKGROUND

In general, refrigerators refer to home appliances in which food may be stored in an internal storage space, which is shielded by a door, at a low temperature. For this, the refrigerator is configured to accommodate the stored food in an optimum state by cooling the internal storage space using cold air generated through heat exchange with a refrigerant circulating in a refrigeration cycle.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door that opens and closes the storage space.

In general, the refrigerator has a problem in that when the door is not opened, internal food may not be identified. That is, the door should be opened to identify whether desired food is received in a space in the refrigerator or in a separate storage space provided in the door. Further, when a user does not exactly know where the food is stored, an opening time of the door may increase or the number of times the door is opened may increase. At this time, unnecessary outflow of cold air may occur.

In recent years, to solve such a limitation, a refrigerator has been developed while allows a portion of a door thereof to be transparent or allows the inside thereof to be visible from the outside.

In some refrigerators, a panel assembly through which the inside of a refrigerator is visible and on which a screen is output is provided on a door of the refrigerator. Also, a structure in which a screen is output by an operation of the panel assembly to transmit information through a see-through part disposed on a front surface is disclosed.

However, in a refrigerator having the above-described structure, there are limitations in that an operation of a large-scale display is essential to transmit information, and the operation state is output, and the information is transmitted through only the output of the screen on the see-through area due to the operation of the display.

SUMMARY

It is an object of the present disclosure to provide a refrigerator in which a plurality of areas on which information is displayed on a transparent panel assembly of a refrigerator door is independently provided to improve convenience in use.

It is an object of the present disclosure to provide a refrigerator in which independent operation state information is displayed regardless of whether a screen is output on a refrigerator door, and the inside of the refrigerator is visible to improve convenience in use.

It is an object of the present disclosure to provide a refrigerator in which a transmission part provided in a refrigerator door is improved in assembly productivity and maintenance performance.

It is an object of the present disclosure to provide a refrigerator in which a second display and a wire connected to the second display are disposed to be separated from an insulator, thereby improving assembly productivity and maintenance performance.

The object is solved by the features of the independent claims. Preferred embodiments are given in the dependent claims.

Particular implementations of the present disclosure provide a refrigerator that includes a cabinet defining a storage space, and a door configured to open and close the storage space. The door may include an outer plate, a door liner, a panel assembly, a first display, a second display, and a frame. The outer plate at least partially defines a front surface of the door and defines a plate opening. The door liner at least partially defines a rear surface of the door and defines a liner opening. The panel assembly is configured to shield the plate opening and the liner opening. The panel assembly includes a first display configured to (i) permit an inside of the refrigerator to be visible from an outside of the panel assembly, and (ii) output a screen. The second display is spaced apart from the first display. The frame is provided between the outer plate and the door liner. The frame includes a first mounting part that mounts the panel assembly thereat, a second mounting part that mounts the second display thereat, and a wire guide part that connects the first mounting part to the second mounting part and that accommodates a wire connected to the second display.

In some implementations, the refrigerator can optionally include one or more of the following features. The wire guide part may be recessed from a front surface of the frame. The second mounting part may extend in parallel with the first mounting part and be spaced downward from a lower end of the first mounting part. The second mounting part may be recessed from a front surface of the frame and accommodates the second display. The second mounting part may have an area that is smaller than an area of the first mounting part. The first mounting part may pass through the frame and support a lateral surface of the panel assembly. The wire may be disposed between an outer surface of the panel assembly and an inner surface of the first mounting part. The first mounting part may include a mounting part wire guide part being recessed along a periphery of the first mounting part and configured to guide the wire therealong. The mounting part wire guide part may be connected to the wire guide part. The frame may include a barrier and a barrier wire guide part. The barrier may be disposed at an upper portion of the frame. The barrier may divide an inside of the door into (i) a first space that positions a printed circuit board (PCB), and (ii) a second space that positions an insulator. The barrier wire guide part may include an opening at the barrier. The opening may receive the wire that is guided along the mounting part wire guide part. A front surface of the panel assembly may include a see-through part, a transmission part, and an opaque bezel. The see-through part may be disposed at a first position corresponding to the first display. The see-through part may be configured to permit the inside of the panel assembly to be visible therethrough. The transmission part may be disposed at a second position corresponding to the second display. The transmission part may be configured to permit light of the second display to be transmitted therethrough. The opaque bezel may be disposed at a third position being different from the first position and the second position. The transmission part may extend in parallel with the see-through part and have a same horizontal width as the see-through part. The panel assembly may include a diffusion sheet configured to shield the transmission part and allow light irradiated from the second display to be illuminated in a form of surface light. The wire guide part may be disposed at the opaque bezel. The panel assembly may include a front panel configured to shield the plate opening, a rear panel spaced backward from the front panel and configured to shield the liner opening, and an outer frame connecting the front panel to the rear panel and defining a lateral surface of the panel assembly. The front panel may have an area being greater than an area of the rear panel and be configured to shield a front side of the second display. The first mounting part may pass through a front surface of the frame and contact a periphery of the outer frame. A rear surface of the front panel may contact the front surface of the frame and be configured to shield the second mounting part. The outer plate may include a bent plate part that is bent along the plate opening. A periphery of the frame may define a bent part accommodating groove into which the bent plate part is inserted. The second mounting part may be disposed between the first mounting part and the bent part accommodating groove. The second display may include a substrate accommodated in the second mounting part, and a plurality of LEDs that are arranged continuously at the substrate and configured to irradiate light. The light may be configured to pass through the panel assembly. The wire may be connected to the substrate. A display support member may be disposed inside the second mounting part and protrude to support the substrate at a rear side. The display support member may be provided in plurality along the second mounting part. The substrate may be spaced apart from an inner surface of the display support member. The second mounting part may include an elastic fixing part and a coupling boss. The elastic fixing part may protrude from an inside of the second mounting part. The elastic fixing part may press a front surface of the substrate and fix the substrate. The coupling boss may support a rear surface of the substrate and couple to a screw passing through the substrate. The door may include a main door configured to open and close the storage space and defining a main door opening, and a sub-door configured to open and close the main door opening. The panel assembly and the second display may be provided at the sub-door.

In one embodiment, a refrigerator includes: a cabinet in which a storage space is defined; and a door configured to open and close the storage space, wherein the door includes: an outer plate which defines a front surface of the door and in which a plate opening is defined; a door liner which defines a rear surface of the door and in which a liner opening is defined; a panel assembly configured to shield the plate opening and the liner opening, the panel assembly including a first display through which the inside thereof is visible, and a screen is output; a second display disposed at a position that is spaced apart from the first display; and a frame provided between the outer plate and the door liner, wherein the frame includes: a first mounting part on which the panel assembly is mounted; a second mounting part on which the second display is mounted; and a wire guide part which connects the first mounting part to the second mounting part and in which a wire connected to the second display is accommodated.

The wire guide part may be recessed from a front surface of the frame.

The second mounting part may be disposed in parallel to be spaced downward from a lower end of the first mounting part.

The second mounting part may be recessed from a front surface of the frame to accommodate the second display.

The second mounting part may have a size less than that of the first mounting part.

The first mounting part may pass through the frame to support a circumferential surface of the panel assembly.

The wire may be disposed between an outer surface of the panel assembly and an inner surface of the first mounting part.

A mounting part wire guide part along which the wire is guided may be recessed along a circumference of the first mounting part, and the mounting part wire guide part may be connected to the wire guide part.

A barrier configured to divide the inside of the door into a space, in which a PCB is disposed, and a space into which an insulator is filled may be disposed on an upper portion of the frame, and a barrier wire guide part through which the wire guided along the mounting part wire guide part passes may be opened in the barrier.

A front surface of the panel assembly may include: a see-through part which is disposed at a position corresponding to the first display and through which the inside thereof is visible; a transmission part which is disposed at a position corresponding to the second display and through which light of the second display is transmitted; and an opaque bezel disposed on a remaining area except for the see-through part and the transmission part.

The transmission part may be disposed parallel to the see-through part and have the same horizontal width as the see-through part.

A diffusion sheet configured to shield the transmission part and allow light irradiated from the second display to be illuminated in a form of surface light may be attached to the panel assembly.

The wire guide part may be disposed on the area of the bezel.

The panel assembly may include: a front panel configured to shield the plate opening; a rear panel disposed to be spaced backward from the front and configured to shield the liner opening; and an outer frame configured to connect the front panel to the rear panel and define a circumferential surface of the panel assembly, wherein the front panel may have a size greater than that of the rear panel so that the front panel shields a front side of the second display.

The first mounting part may pass through a front surface of the frame to extend to be in contact with a circumference of the outer frame, and a rear surface of the front panel may be mounted to be in contact with the front surface of the frame so as to shield the second mounting part.

A bent plate part bent along the plate opening may be disposed on the outer plate, a bent part accommodating groove into which the bent plate part is inserted may be defined in a circumference of the frame, and the second mounting part may be disposed between the first mounting part and the bent part accommodating groove.

The second display may include: a substrate accommodated in the second mounting part; and an LED which is provided in plurality to be arranged continuously on the substrate and from which light is irradiated to pass through the panel assembly, wherein the wire may be connected to the substrate.

A display support member protruding to support the substrate at a rear side may be provided inside the second mounting part, and the display support member may be provided in plurality along the second mounting part so that the substrate is disposed to be spaced apart from an inner surface of the display mounting part.

The second mounting part may include: an elastic fixing part protruding from the inside of the second mounting part to press a front surface of the substrate, thereby fixing the substrate; and a coupling boss which supports a rear surface of the substrate and to which a screw passing through the substrate is coupled.

The door may include: a main door which is configured to open and close the storage space and in which an opening is defined; and a sub-door configured to open and close the opening, wherein the panel assembly and the second display are provided in the sub-door.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the scope of the present disclosure is not limited to proposed embodiments of the present disclosure, and other regressive inventions or other embodiments included in the scope of the present disclosure may be easily proposed through addition, change, deletion, and the like of other elements.

Figure 1:
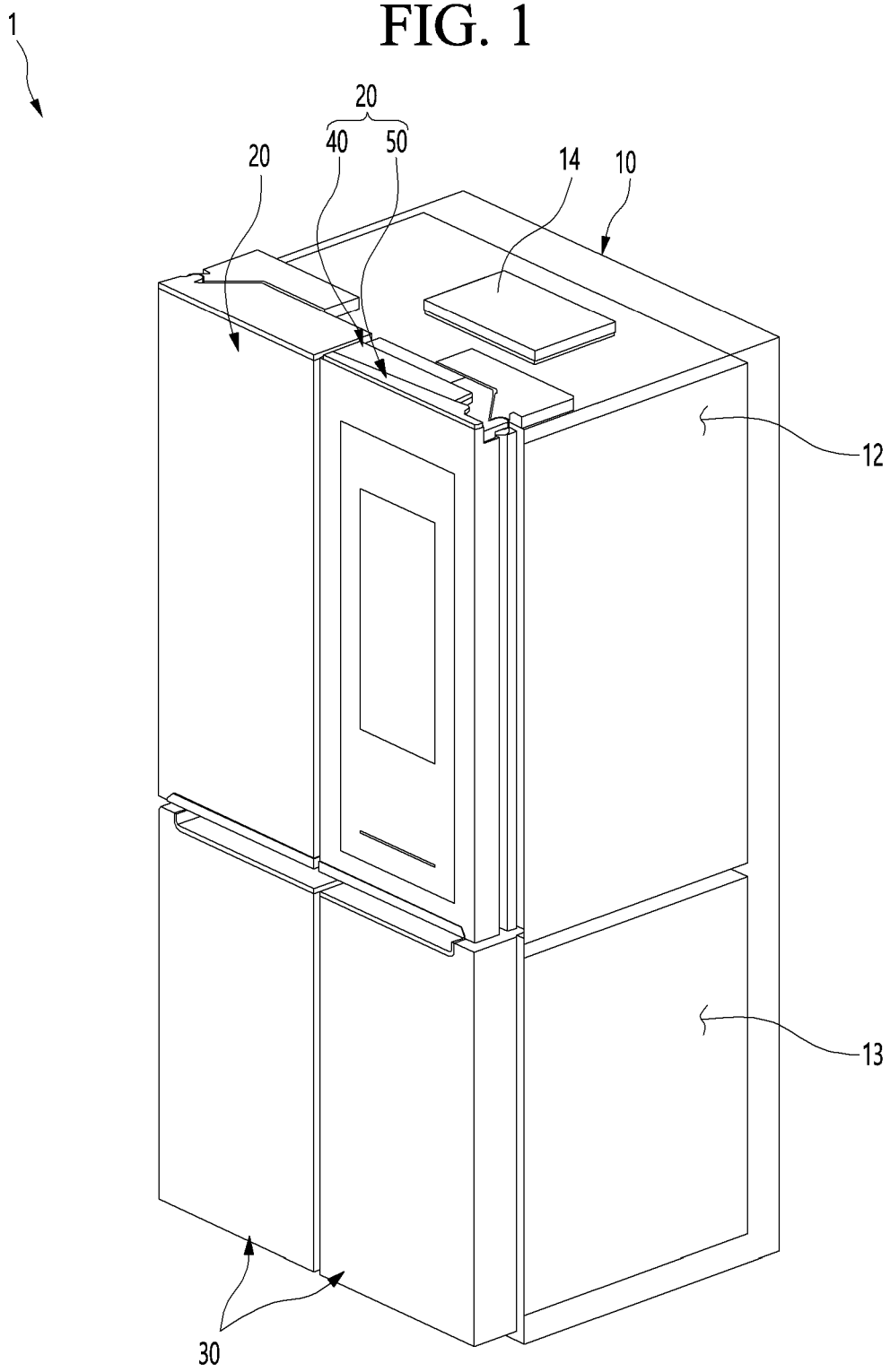
FIG. 1 is a perspective view of a refrigerator according to an embodiment.

FIG. 1 is a perspective view of a refrigerator according to an embodiment.

Figure 2:
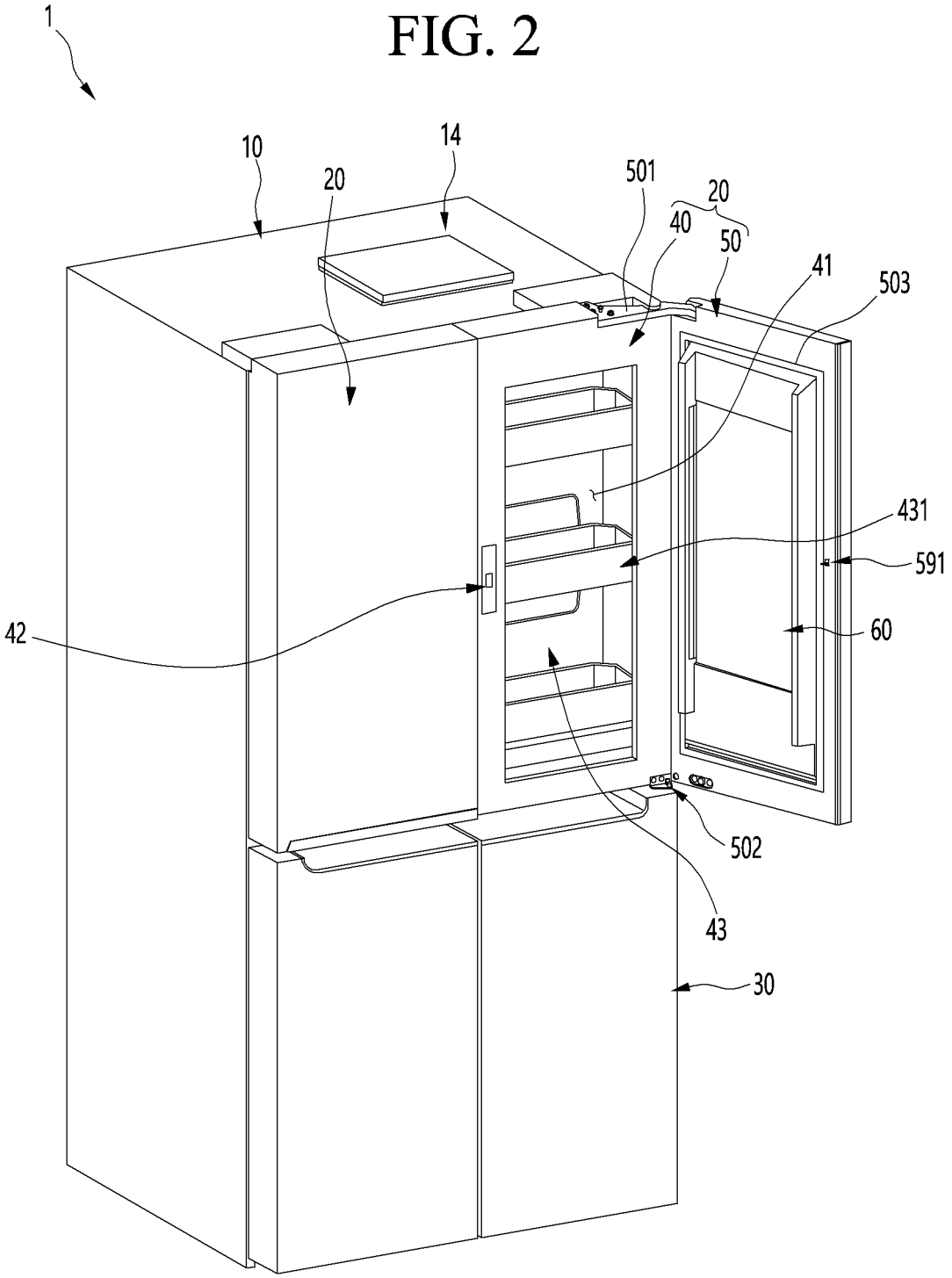
FIG. 2 is a perspective view of the refrigerator with a sub-door opened.

Referring to FIGS. 1 and 2, a refrigerator 1 according to a first embodiment of the present disclosure includes a cabinet 10 defining a storage space and a door that opens or closes the storage space. Here, an outer appearance of the refrigerator 1 may be defined by the cabinet 10 and the door.

Figure 11:
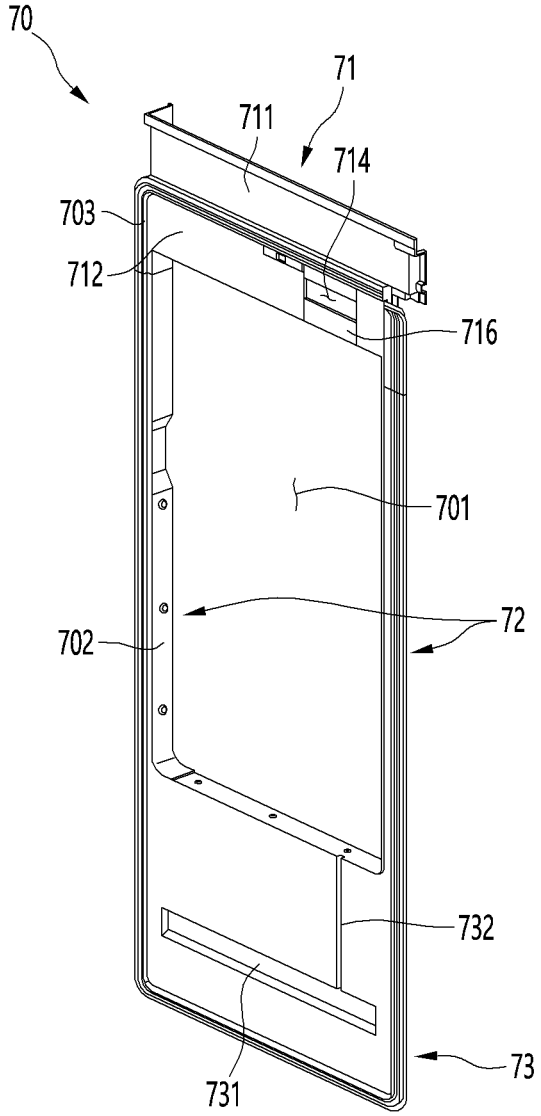
FIG. 11 is a front perspective view of a support frame that is one component of the sub-door.

The inside of the cabinet 10 is partitioned into upper and lower portions by a barrier (see FIG. 11). A refrigerating compartment 12 may be defined in the upper portion of the cabinet 10, and a freezing compartment 13 may be defined in the lower portion of the cabinet 10.

Also, a control unit 14 for controlling an overall operation of the refrigerator 1 may be disposed on a top surface of the cabinet 10. The control unit 14 may be configured to control a cooling operation of the refrigerator as well as electric components for selective viewing and screen output of a see-through part 611.

The door may include a refrigerating compartment door and a freezing compartment door 30. The refrigerating compartment door 20 may be opened and closed by rotating an opened front surface of the refrigerating compartment 12, and the freezing compartment door 30 may be switched by rotating an opened front surface of the freezing compartment 13.

Also, the refrigerating compartment door 20 may be provided in a pair of left and right doors. Thus, the refrigerating compartment 12 is shielded by the pair of doors. The freezing compartment door 30 may be provided in a pair of left and right doors. Thus, the freezing compartment 13 may be opened and closed by the pair of doors. Alternatively, the freezing compartment door 30 may be withdrawable in a draw type as necessary and provided as one or more doors.

Although a refrigerator in which, a French type door in which a pair of doors rotate to open and close one space is applied to a bottom freezer type refrigerator in which the freezing compartment 13 is provided at a lower portion, is described as an example in this embodiment, the present disclosure may be applied to all types of refrigerators including door without being limited to shapes of the refrigerators.

At least one door may be provided so that the inside of the refrigerator is visible through the door. A see-through part 611 that is an area, through which the storage space in the rear surface of the door and/or the inside of the refrigerator are seen, may be provided in the refrigerating compartment door 20. The see-through part 611 may constitute at least a portion of a front surface of the refrigerating compartment door 20. The see-through part 611 may be selectively transparent or opaque according to user's manipulation.

Thus, foods accommodated in the refrigerator may be identified through the see-through part 611.

Also, although the structure in which the see-through part 611 is provided in the refrigerating compartment door 20 is described as an example in this embodiment, the see-through part 611 may be provided in various different types of refrigerator doors such as the freezing compartment door 30 according to a structure and configuration of the refrigerator.

FIG. 2 is a perspective view of the refrigerator with a sub-door opened. Also, FIG. 3 is a perspective view of the refrigerator with a main door opened.

Figure 3:
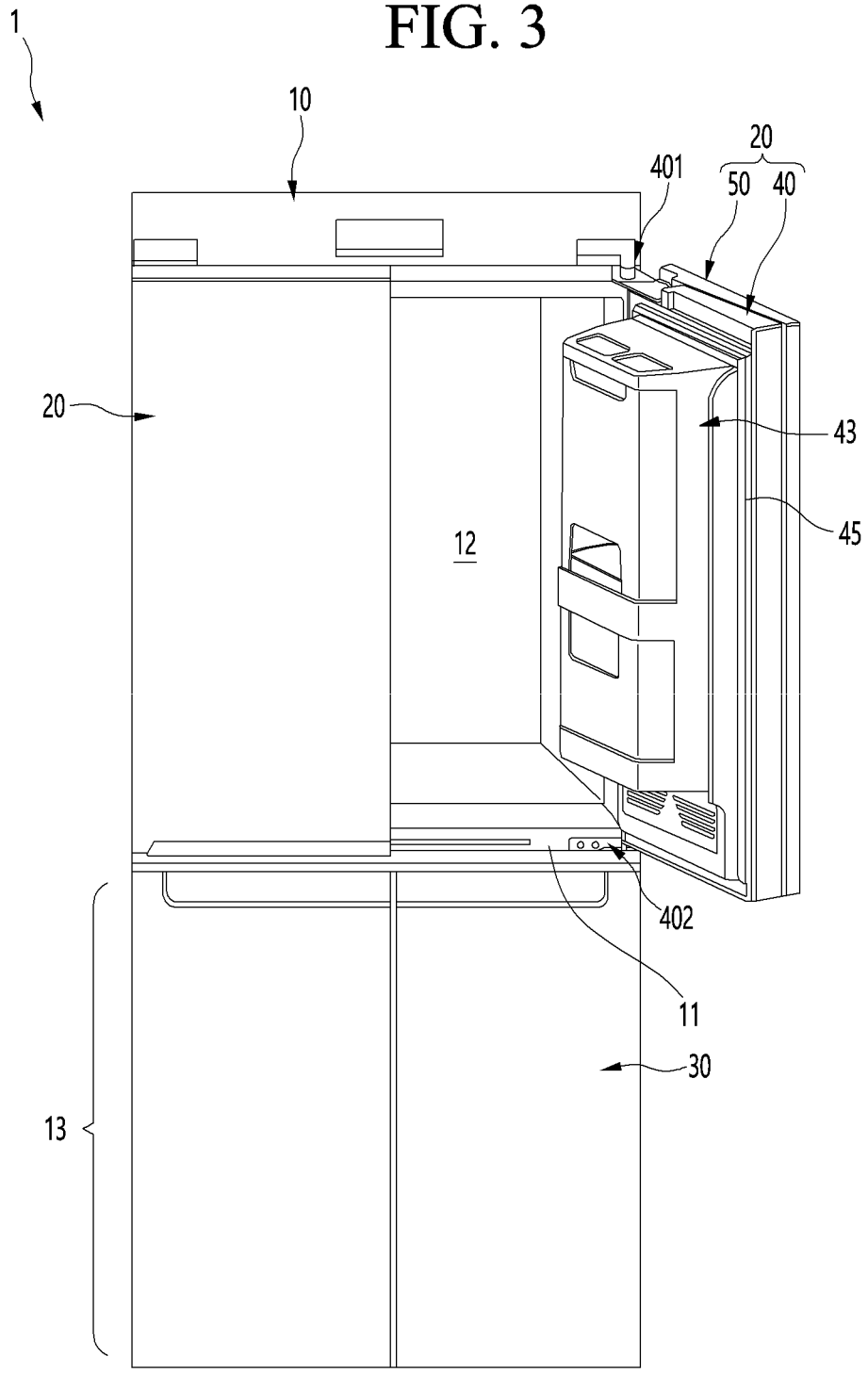
FIG. 3 is a perspective view of the refrigerator with a main door opened.
Figure 4:
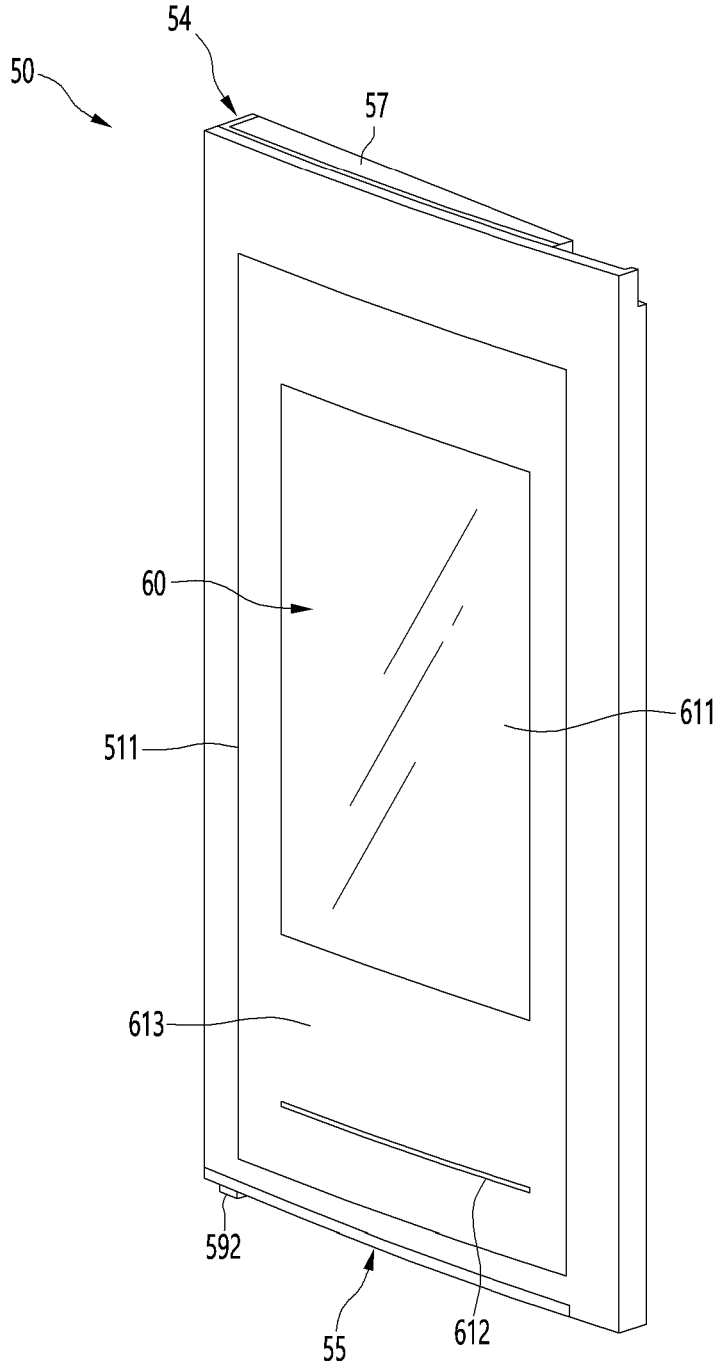
FIG. 4 is a front perspective view of the sub-door.

As illustrated in FIGS. 3 and 4, the refrigerating compartment door 20, which is disposed at the right side (when viewed in FIG. 3), of the pair of refrigerating compartment doors 20 may be doubly opened and closed. In detail, the refrigerating compartment door 20, which is disposed at the right side, may include a main door 40 that opening and closing the refrigerating compartment 12 and a sub-door 50 rotatably disposed on a main door 40 to open and close an opening defined in the main door 40.

The main door 40 may have the same size as that of the refrigerating compartment door 20, which is disposed at the left side (when viewed in FIG. 1), of the pair of refrigerating compartment doors 20. The main door 40 may be rotatably mounted on the cabinet 10 by an upper hinge 401 and a lower hinge 402 to open at least a portion of the refrigerating compartment door 12.

Also, an opening 41 that is opened with a predetermined size is defined in the main door 40. A door basket 431 may be mounted on the rear surface of the main door 40 as well as the inside of the opening 41. Here, the opening 41 may have a size that occupies most of the front surface of the main door 40 except for a portion of a circumference of the main door 40.

A storage case 43 may be provided on the rear surface of the main door 40. A plurality of door baskets may be disposed in the storage case 43. When the sub-door 50 is opened, the storage case 43 may have a structure that is accessible through the opening 41. Also, the storage case 43 may be provided with a case door to access the inside of the storage case from the rear surface of the main door 40.

Also, a main gasket 45 may be disposed on a circumference of the rear surface of the main door 40 to prevent cool air within an internal space of the cabinet 10 from leaking when the main door 40 is opened. The sub-door 50 may be rotatably mounted on the front surface of the main door 40 to open and close the opening 41. Thus, the sub-door 50 may be opened to expose the opening 41.

The sub-door 50 may have the same size as the main door 40 to cover the entire front surface of the main door 40. Also, when the sub-door 50 is closed, the main door 40 and the sub-door 50 may be coupled to each other to provide the same size and configuration as those of the left refrigerating compartment door 20. Also, a sub gasket 58 may be disposed on the rear surface of the sub-door 50 to seal a gap between the main door 40 and the sub-door 50.

A panel assembly 60 through which the inside of the refrigerator is selectively visible and on which a screen is capable of being output is provided at a center of the sub-door 50. Thus, even though the sub-door 50 is closed, the inside of the opening 41 may be selectively visible, and also an image inside the opening 41 may be output. The see-through part 21 may be a portion of the sub-door 50, through which the inside of the refrigerator 1 is visible. However, the see-through part 21 may not necessarily match the entirety of the panel assembly 60.

The panel assembly 60 may be configured to be selectively transparent or opaque according to user's manipulation. Thus, only when the user desires, the transparent panel assembly 60 may be transparent so that the inside of the refrigerator 1 is visible, otherwise, be maintained in the opaque state. Also, the panel assembly 60 may output a screen in the transparent or opaque state.

In the embodiment, the panel assembly 60 is configured to shield an opened portion of the sub-door 50. However, according to types of the door, even when one door is configured as in the right door 20 of the refrigerating compartment 12, an opening may be formed in the door 20, and the transparent panel assembly may be mounted to shield the opening of the door 20. That is, it is noted that the panel assembly 60 may be applied to all types of doors, through which an opening is formed, regardless of the shape of the refrigerator and the shape of the door.

A sub upper hinge 501 and a sub lower hinge 502 may be respectively provided on upper and lower ends of the sub-door 50 so that the sub-door 50 is rotatably mounted on the front surface of the main door 40. Also, a restraint device 591 may be provided on the sub-door 50. A locking unit 42 may be provided on the main door 40 to correspond to the restraint device 591. Thus, the sub-door 50 may be maintained in the closed state by the coupling between the restraint device 591 and the locking unit 42. When the coupling between the opening device 59 and the locking unit 42 is released by manipulation of an opening device 529 provided at a lower end of the door, the sub-door 50 may be opened.

Hereinafter, a structure of the sub-door 50 will be described in more detail with reference to the accompanying drawings.

Figure 5:
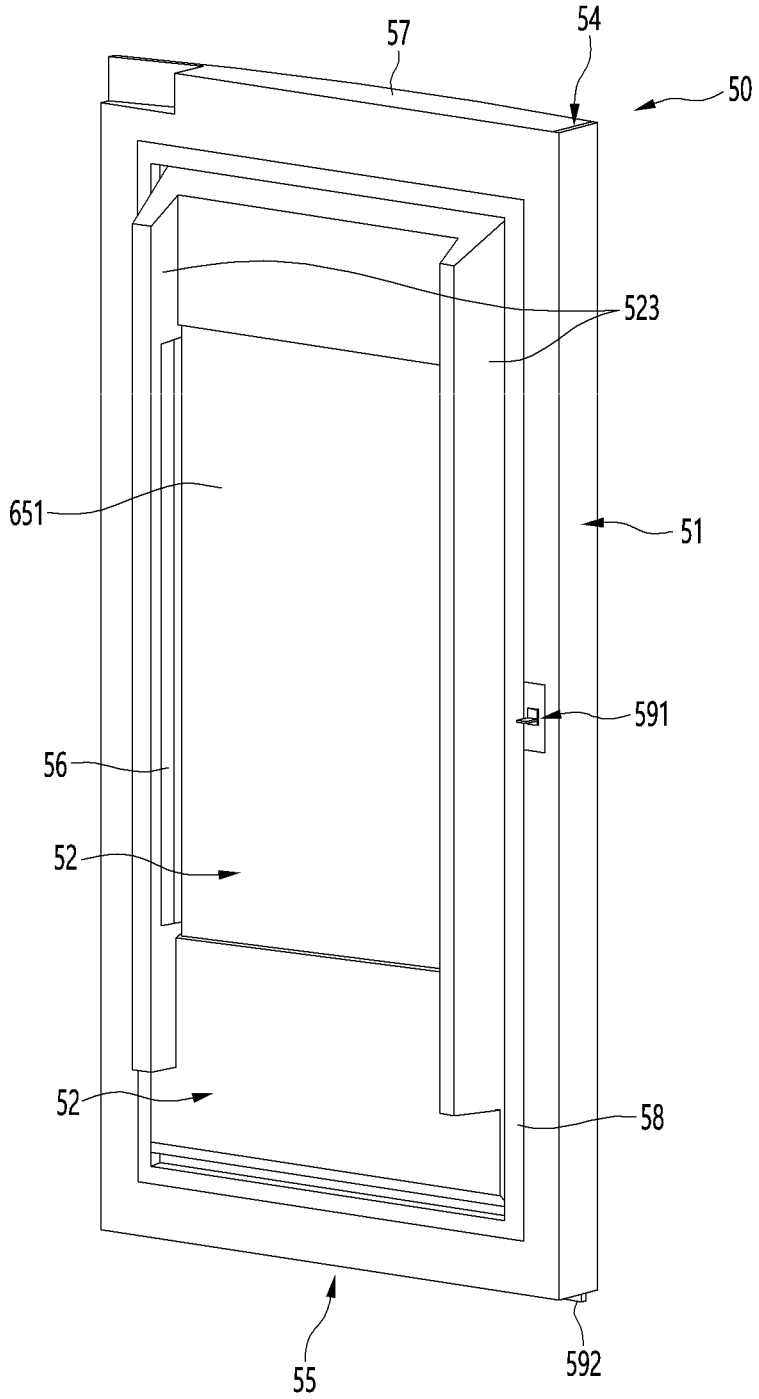
FIG. 5 is a front perspective view of the sub-door.
Figure 6:
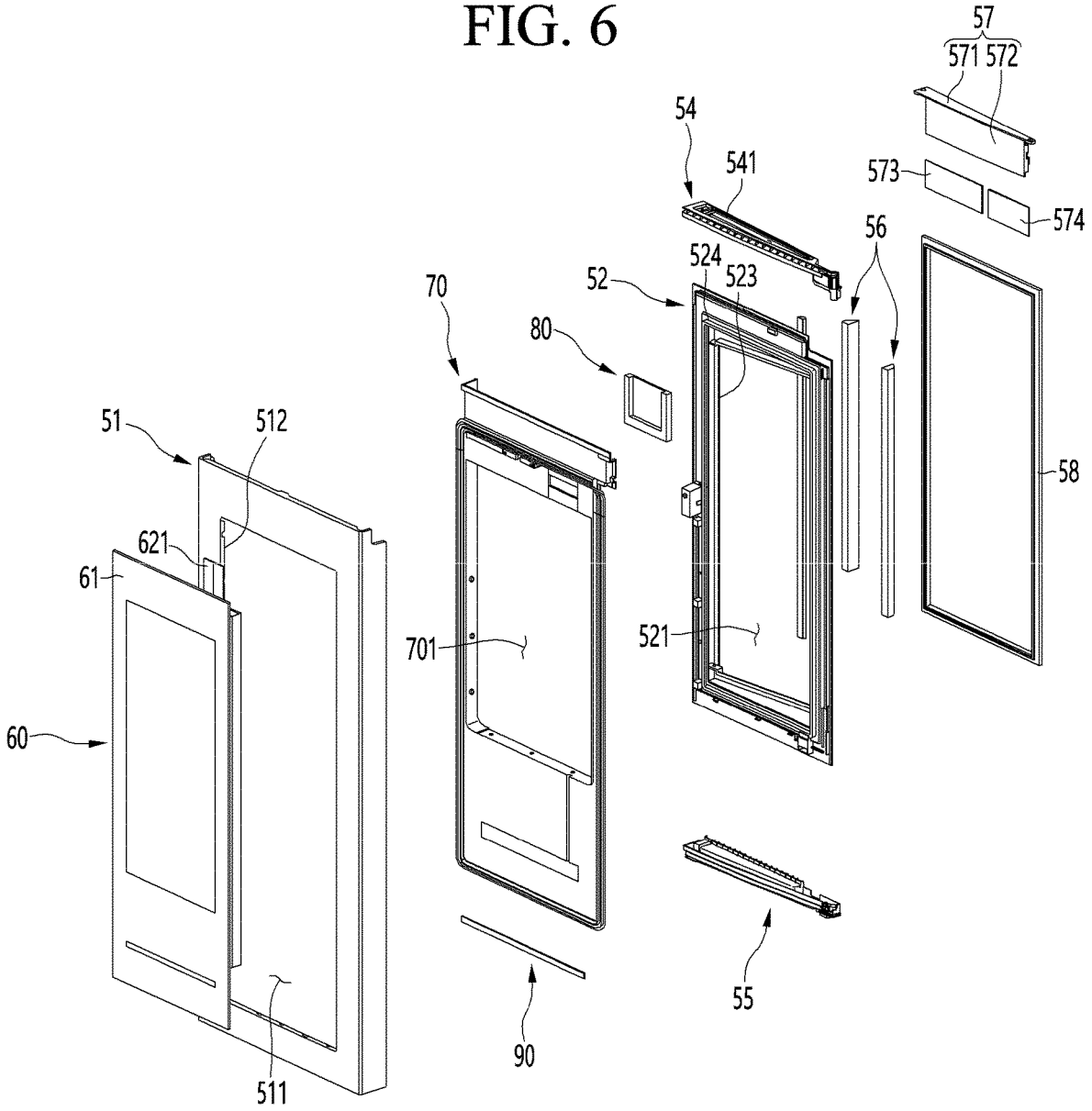
FIG. 6 is an exploded perspective view of the sub-door.

FIG. 4 is a front perspective view of the sub-door. Also, FIG. 5 is a perspective view of the sub-door when viewed from a front side. Also, FIG. 6 is an exploded perspective view of the sub-door.

As illustrated in the drawings, the sub-door 50 may include an outer plate 51 defining an outer appearance of the sub-door 50, a door liner 52 mounted to be spaced apart from the outer plate 51, the panel assembly 60 mounted on an opening of the outer plate 51 and the door liner 52, and upper and lower cap decorations 54 and 55 defining the top and bottom surfaces of the sub-door 50. The above-described constituents may be coupled to define the whole outer appearance of the sub-door 50.

The outer plate 51 may constitute an outer appearance of the front surface of the sub-door 50 and a portion of a peripheral surface of the sub-door 50 and be made of a stainless steel material. The outer plate 51 may constitute a portion of the outer appearance of the sub-door 50 as well as the front surface of the sub-door 50. Also, the outer plate 51 may be made of the same material of the front surface of each of the refrigerating compartment door 20 and the freezing compartment door 30. Various surface treatments such as coating or film attachment so as to realize anti-fingerprint coating, hair lines, colors, or patterns may be performed on the front surface of the outer plate 51.

Also, a plate opening 511 may be defined at a center of the outer plate 51. Here, the plate opening 511 may be shielded by the panel assembly 60. Also, since the inside of the refrigerator 1 is visible through the panel assembly 60 that shields the plate opening 511, an internal region of the plate opening 511 may be referred to as the see-through part 611.

A bent plate part 514 that is bent backward may be disposed on a peripheral surface of the plate opening 511. The bent plate part 514 may be disposed along a circumference of the plate opening 511 and extend by a predetermined length so as to be inserted into and fixed to a plate accommodating groove 703 of a frame 70 to be described below.

Both surfaces of the outer plate 51 may be bent to define an outer appearance of a side surface of the sub-door 50. Both ends of the outer plate 51 may be coupled to the door liner 52. Also, upper and lower ends of the outer plate 51 may be coupled to the upper cap decoration 54 and the lower cap decoration 55, respectively. An insulator 53 may be filled inside the outer plate 51, the door liner 52, the upper cap decoration 54, and the lower cap decoration 55.

The door liner 52 defines the rear surface of the sub-door 50 and has a door liner opening 521 in the area on which the panel assembly 60 is disposed. Also, a sub gasket 58 for sealing a gap between the sub-door 50 and the main door 40 may be mounted on the rear surface of the door liner 52.

Also, a door light 56 may be provided on each of both sides of the door liner opening 521. The door light 56 may illuminate the rear surface of the sub-door 50 and a rear side of the panel assembly 60.

Thus, when the door light 56 is turned on, the inside of the storage case 43 may be brightened, and thus, the inside of the refrigerator may be more brightened up than the outside of the refrigerator so that a rear space of the sub-door 50 may be visible through the panel assembly 60.

Also, if the door light 56 is turned on when the panel assembly 60 outputs the screen, the panel assembly 60 may function as an auxiliary backlight to allow the screen to be clearer.

The door light 56 may be mounted on the light mounting part 523 disposed on the rear surface of the sub-door 50. The light mounting part 523 may be disposed on the door liner 52 to protrude rearward along each of both left and right ends of the liner opening 521. Here, the light mounting part 523 may be disposed further behind the panel assembly 60, protrude backward, and pass through the opening 41 in a state in which the sub-door 50 is closed so that the light mounting part 523 is accommodated in the storage case 43. Also, the light mounting parts 523 may be opened in a direction facing each other, and the door lights 56 may be mounted inside the opened sides to irradiate light in the direction facing each other.

The upper cap decoration 54 may define a top surface of the sub-door 50 and be coupled to upper ends of the outer plate 51 and the door liner 52. The top surface of the upper cap decoration 54 is opened so that a decoration opening 541 communicating with an upper space of the panel assembly 60 is formed, and is shielded by a decoration cover 57.

The decoration cover 57 may include a shielding part 571 that shields the decoration opening 541 and a PCB mounting part 572 extending downward from a bottom surface of the shielding part 571. The PCB mounting part 572 may be mounted with PCBs 573 and 574 for an operation the panel assembly 60 and electrical components inside the sub-door 50. The PCBs 573 and 574 may be configured in at least one module form and may be provided in the PCB accommodating space 710 above the sub-door 50.

Here, an inner space of the sub-door 50 except for the PCB accommodating space 710 communicating with the decoration opening 541 may be filled with an insulator 53.

The lower cap decoration 55 may define a bottom surface of the sub-door 50 and be coupled to lower ends of the outer plate 51 and the door liner 52. Also, the lower cap decoration 55 may be provided with a manipulation device 592 that opens the sub-door 50. Also, the lower cap decoration 55 may be further provided with a handle groove that is recessed upward and into which a user's hand is inserted during the rotation operation for the opening of the sub-door 50.

The panel assembly 60 may be disposed between the outer plate 51 and the door liner 52. Also, the panel assembly 60 may be configured to shield the plate opening 511 and the door liner opening 521. Also, the panel assembly 60 may be selectively manipulated to one state of transparent, translucent, opaque, and screen output states by the user.

Thus, the user may selectively see through the inner space of the sub-door 50 through the panel assembly 60 and see the screen output through the panel assembly 60.

The frame 70 configured to support the panel assembly 60 is mounted on a circumference of the plate opening 511 of the outer plate 51. The panel assembly 60 may be maintained in the fixed and mounted state by the frame 70. Particularly, a front surface of the outer plate 51 and a front surface of the panel assembly 60 may be disposed on the same extension line so that a front surface of the sub-door 50 has a sense of unity.

A frame opening 701 is defined at a center of the frame 70. The frame opening 701 has a size somewhat less than that of the plate opening 511 and has a structure in which the panel assembly 60 is seated thereon. In the state in which the panel assembly 60 is mounted on the frame 70, the front surface of the panel assembly 60 may shield the plate opening 511 and be exposed forward. A rear surface of the panel assembly 60 may shield the liner opening 521 and be exposed backward.

Also, the frame 70 may have a coupling structure with the outer plate 51. Here, the outer plate 51 and an end of the panel assembly 60 may be mounted on the inner frame 52 in a state in which the outer plate 51 and the end of the panel assembly 60 are closely attached to each other. Thus, when the sub-door 50 is viewed from the front side, an end of the outer plate 51 and a periphery of the panel assembly 60 are in close contact with each other, so that a gap between the outer plate 51 and the panel assembly 60 is rarely seen or is seen in a form of a line, and the outer appearance of the front surface may be seen as having senses of continuity and unity.

The panel assembly 60 may have a size that is enough to cover the plate opening 511 and the liner opening 561 inside the sub-door 50. Also, the see-through part 21 may be provided in the transparent panel assembly 60 so that the inner space of the refrigerator is selectively visible, and a screen is outputted.

Also, the front surface of the panel assembly 60, which is exposed at the front side through the outer plate 51, may include the see-through part 611 through which the inside behind the panel assembly 60 is visible and on which a screen including an image and/or video is output, a bezel 613 provided to be opaque along a circumference of the see-through part 611. The panel assembly 60 may further include a transmission part 612 through which light can pass. The transmission part 612 is provided at a lower side of the assembly 60, in particular at a lower side of the see-through part 611.

In detail, the bezel 613 may be disposed on a circumference of a front panel 61 defining the front surface of the panel assembly 60. The bezel 613 may be printed with an opaque material having a color such as black. Components disposed behind the front panel 61 may be covered so as not to be exposed to the outside.

On a central portion or area of the front panel 61*a* see-through part 611 is provided. This part is transparent or semi transparent. The see-through part 611 is a part on which the bezel 613 is not disposed. The see-through part 611 may have a size corresponding to a position corresponding to a first display 63. Thus, the see-through part 611 defines an area through which the inside of the refrigerator is visible and defines an area on which the screen is output when the first display 63 operates. Thus, the see-through part 611 may be referred to as an output part, a visualization part, and a visualization area.

The transmission part 612 is narrower in a vertical direction and extends lengthily in a horizontal direction, may be disposed below the see-through part 611. The transmission part 612 may be transparent or semi transparent part which may be realized as a horizontal stripe or as a plurality of very tiny transparent or semi transparent spots arranged in a horizontal bar shape. The transmission part 612 may also be provided to allow light to be transmitted because the bezel 613 or the opaque material of the bezel 613 is not provided in area of the transmission part 612. Thus, information may be displayed. This information may include an operation state of the refrigerator 1 displayed by the transmitted light.

For example the information provided by the transmission part 612 may be at least one of a voice recognition state, a touch or note operation input state, an internal temperature, a time setting state, and the like and/or may be displayed as a partial emission area such as a bar graph. In addition, while the partial emission area moves, the transmission part 612 may be dynamically displayed. Since the transmission part 612 is displayed in the form of a line, the transmission part 612 may be referred as a display.

Hereinafter, a structure of the panel assembly will be described in more detail with reference to the accompanying drawings.

Figure 7:
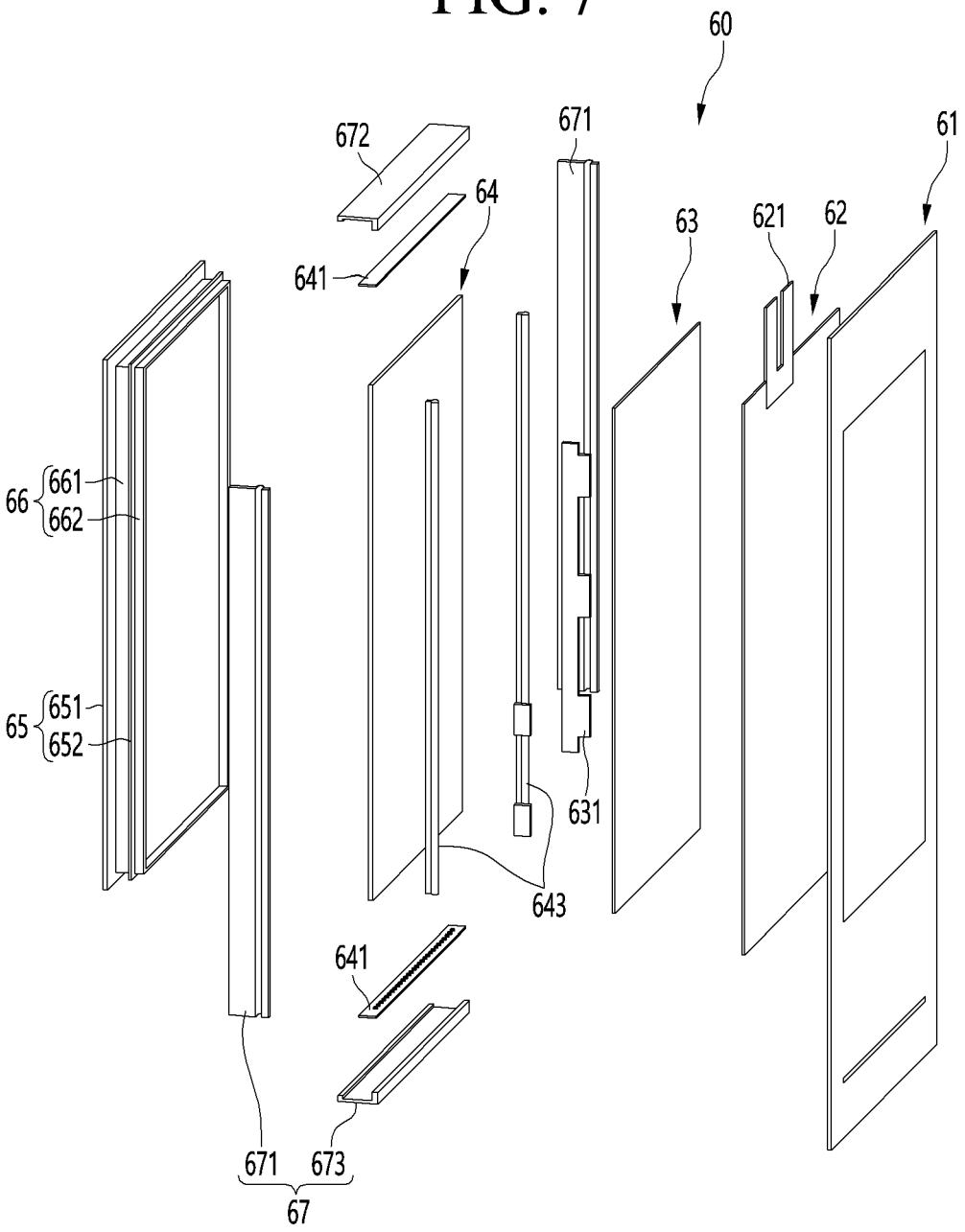
FIG. 7 is an exploded perspective view of the panel assembly that is one component of the sub-door.
Figure 8:
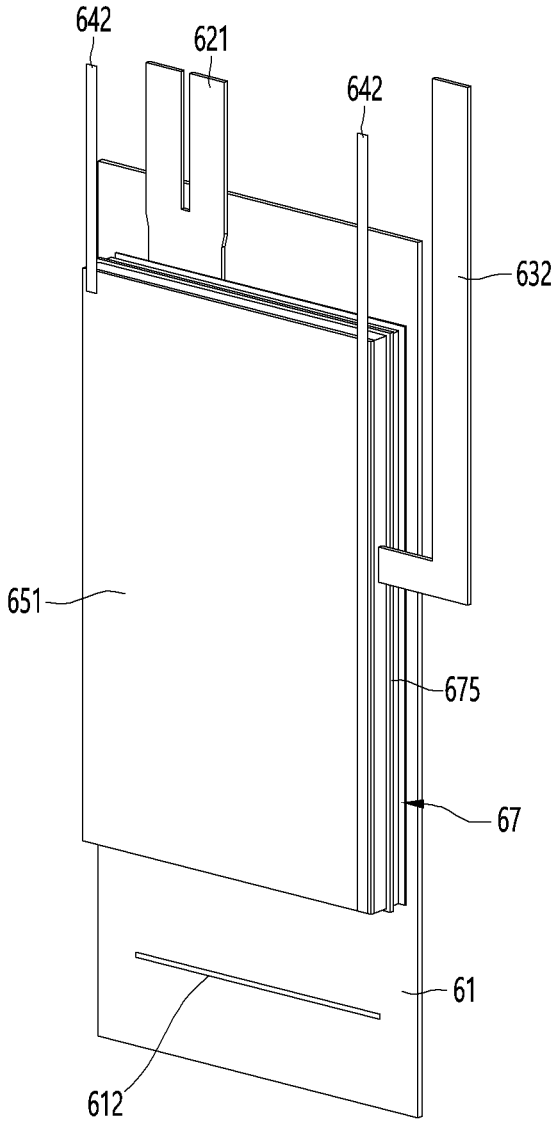
FIG. 8 is a rear perspective view of the panel assembly.
Figure 9:
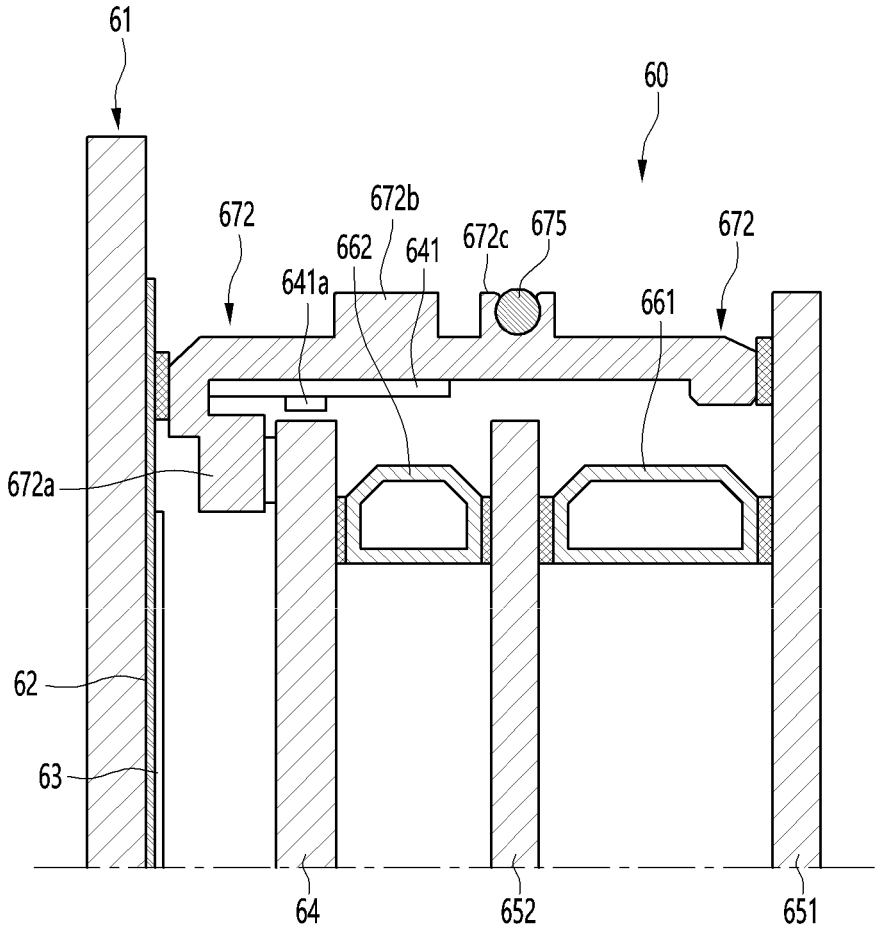
FIG. 9 is a cross-sectional view illustrating an upper end of the panel assembly.
Figure 10:
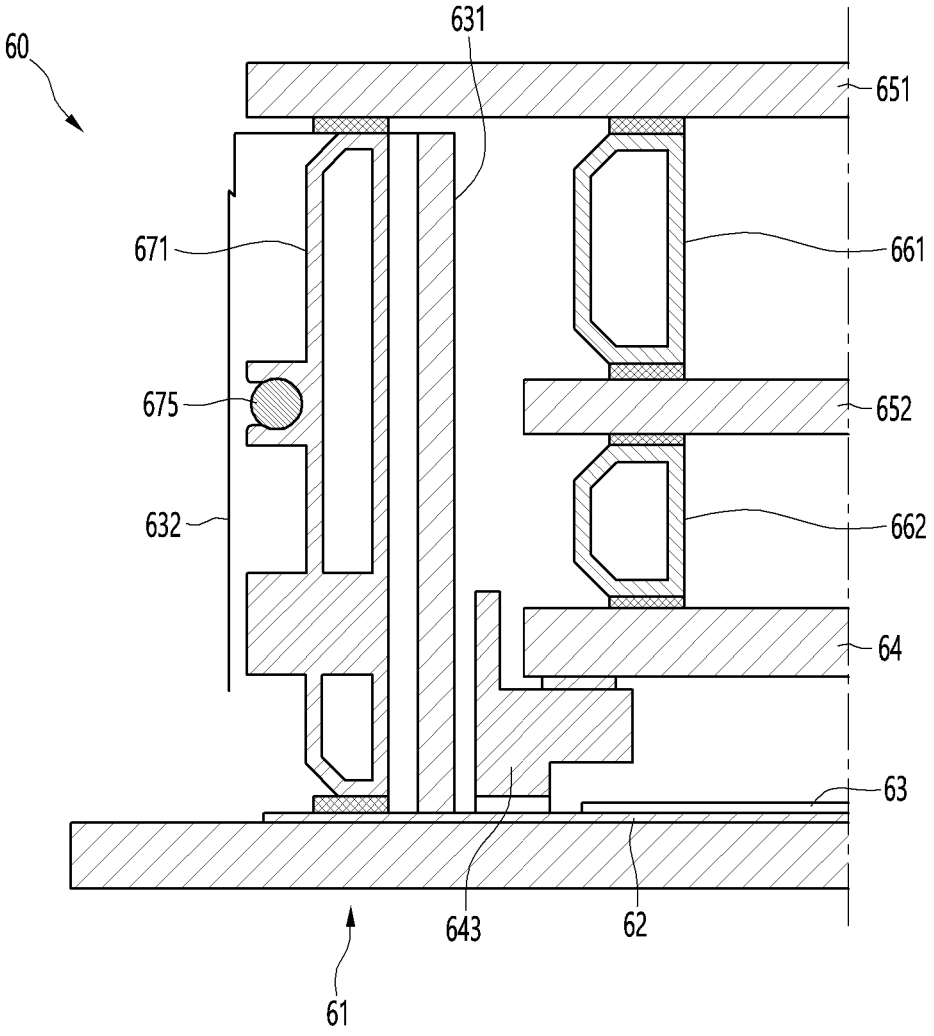
FIG. 10 is a cross-sectional view illustrating one end of the panel assembly.

FIG. 7 is an exploded perspective view of the panel assembly that is one component of the sub-door. Also, FIG. 8 is a rear perspective view of the panel assembly. Also, FIG. 9 is a cross-sectional view illustrating an upper end of the panel assembly. Also, FIG. 10 is a cross-sectional view illustrating one end of the panel assembly.

As shown in the drawings, the panel assembly 60 may be constituted by a plurality of plate-shaped panels, and each of the panels may be spaced a predetermined intervals from each other by at least one spacer to constitute one assembly.

In detail, the panel assembly 60 may have an outer appearance that is defined by the front panel 61 and the rear panel 65, which define the front and rear surfaces of the transparent panel assembly 60.

The panel assembly 60 may further include an outer frame 67 connecting the front panel 61 to the rear panel 65.

The front panel 61 may be made of a transparent material (e.g., blue glass) that defines an outer appearance of the front surface of the panel assembly 60. The front panel 61 may have a size corresponding to that of the plate opening 511 and/or may have a size greater than that of the frame opening 701. Thus, the rear surface of the front panel 61 may be supported by the frame 70. In a state in which the panel assembly 60 is mounted, an end of the front panel 61 may be in contact with an end of the plate opening 511, and the plate opening 511 and a circumference of the front panel 61 may be in contact with each other.

In detail, the circumference of the front panel 61 may further protrude outward than the rear panel 65. Thus, the circumference of the front panel 61 defining the front surface of the panel assembly 60 may further extend to the outside of the frame opening 701 and thus may be stably supported by the frame 70. The rear panel 65 as well as the outer frame 67 may be inserted into the frame opening 701.

Also, the frame 70 may be coupled to the panel assembly 60 by a coupling member such as a screw coupling the outer frame 67 to the panel assembly 60. Thus, the circumference of the panel assembly 60 may be supported by the frame 70, and simultaneously, the frame 70 may be coupled to the outer frame 67 so that the heavy panel assembly 60 is maintained in a stably fixed and mounted state even when the sub-door 50 is opened and closed.

A touch screen (touch screen bonding TSB) 62 may be disposed on the rear surface of the front panel 61. The touch screen 62 may have a transparent film shape and be attached to the rear surface of the front panel 61. Thus, even when information is displayed in the area of the see-through part 611, or the screen is output on the first display 63, the see-through part 611 may not affect the output of the screen. The touch screen 62 may be configured to sense user's touch manipulation and may be referred to as a touch sensing device or a touch sensor.

The touch screen 62 may have a size that is at least equal to or larger than that of the see-through part 611 or the first display 63. Thus, when the user touches the area of the see-through part 611, i.e., the screen output area of the front panel 61 of the first display 63, the screen output area may be sensed by the touch screen 62, and thus, information may be input and displayed according to the sensed position.

A touch cable 621 connected to the touch sensor 62 may be disposed on an outer end of the front panel 61. The touch cable 621 may connect the touch screen 62 to the PCB 573 above the sub-door 50. That is, the PCB 573 spaced apart from the touch screen 62 and the touch screen 62 may be connected to each other by the touch cable 621.

Also, the touch cable 621 may be provided as a flexible film type cable such as a flexible flat cable (FFC) or a flexible print cable or flexible print circuit board (FPC). A printed circuit may be printed on the touch cable 621 to constitute at least a portion of the PCB 573.

The touch cable 621 may be connected to the touch screen 62 to extend upward. Also, the touch cable 621 may be configured so that a wire is disposed on a base made of a resin material such as a film and may extend upward along the rear surface of the front panel 61. The touch cable 621 may be flexibly bent so that the touch cable 601 has a thin thickness and a wide width like a sheet.

Also, the touch cable 621 may have a shape such as a film or a sheet and thus may have a structure in which an end of the touch cable 621 is easily connected to a connector **573*a* of the PCB 573 when connected to the PCB 573. In addition, the touch cable 621 may be disposed along the rear surface of the front panel 61 and disposed along a wall surface of the inner space of the sub-door 50 to efficiently arrange the space inside the sub-door 50**.

In addition, not only the touch cable 621, but also the first display cable 632 connected to the display 63 and the light cable 642 connected to the display light 641 may have the same structure. All of the cables 6621, 632, 642, each of which has a flat cable shape as described above, may extend up to an upper end of the panel assembly 60 and may be guided to the PCB accommodating space 710 defined in the upper end of the sub-door 50 having a thin width and wide width. In addition, a simple structure connected to the PCB 573 disposed above the sub-door 50 may be provided.

The first display 63 may be disposed on the rear surface of the front panel 61. The first display 63 may be configured to output a picture or an image through the see-through part 611 and may have a size corresponding to that of the see-through part 611. The first display 63 may be provided in the form of a module on which a scree is capable of being output. Also, the display 63 may be transparent so that the user sees the inside through the display 63 when the screen is not outputted. Thus, the first display 63 may be referred to as a transparent display and may have various shapes. Also, the first display 63 may be referred to as a main display 63 so as to be distinguished from the second display 90.

A source board 631 may be disposed on one end of both left and right sides of the first display 63. The source board 631 may be configured to output a screen through the first display 63 and connected to the first display 63 and thus provided in an assembled state. Also, a portion of the source board 631 may also have a flexible film type cable structure.

Also, the source board 631 may be disposed inside the outer frame 67. The source board 631 may be disposed inside a side part 671 that defines each of left and right sides of the panel assembly 60 of the outer frame 67. Thus, the source board may be disposed so as not to be exposed through the see-through part.

The source board 631 may be connected to the display cable 632. The display cable 632 may have a flexible and flat structure like the touch cable 621 and also have a structure that is freely bendable.

The display cable 632 may be bent to extend along the circumferential surface of the panel assembly 60, i.e., be bent so that an end thereof extends upward from the transparent panel assembly 60. Thus, the display cable 632 may be coupled to the PCB 573 inside the PCB accommodating space defined in the upper end of the sub-door 50.

A first spacer 643 may be provided on each of both left and right sides of the first display 63. The first spacer 643 may allow the first display 63 and the light guide plate 64 to be maintained at a set distance. Also, the first spacer 643 may have a rod shape extending from an upper end to a lower end of the first display 63 and may be made of aluminum.

The light guide plate 64 may be disposed behind the first display 63 and be seated on the first spacer 643 so as to be spaced a predetermined distance from the display 63. The light guide plate 64 is configured so that light irradiated from the display light 641 is diffused or scattered to illuminate the first display 63 at the rear side. For this, the light guide plate 64 may have a plate shape having a size equal to or somewhat greater than that of the first display 63. The display light 641 may be disposed at a position corresponding to at least one of upper and lower ends of the light guide plate 64 or each of the upper and lower ends of the light guide plate 64.

The rear panel 65 may include a rear panel 651 and a heat insulation panel 652. The rear panel 651 may be disposed at a rear side of the light guide plate 64. The rear panel 651 may define the rear surface of the panel assembly 60 and have a size greater than that of the light guide plate and less than that of the front panel 61. Also, the rear panel 651 may have a size greater than that of the liner opening 561 to cover the liner opening 561.

A pair of second spacers 66, 661, 661 may be disposed between the rear panel 651 and the light guide plate 64. Each of the second spacers 66, 661 and 662 may have a rectangular frame shape and be disposed along a circumference of each of an insulation panel 652 and the rear panel 651.

The insulation panel 652 for heat insulation may be provided between the pair of second spacer 661 and 662. The insulation panel 652 may be maintained to be spaced a set interval from each of the insulation panel 652 and the rear panel 651 by the pair of second spacers 661 and 662. A double-layered insulating space may be defined by the pair of second spacers 661 and 662, the insulation panel 652, and the rear panel 651.

In detail, the second spacers 662 disposed at the front side may support each of a rear surface of the light guide plate 64 and a rear surface of the insulation panel 652. In this case, the second spacer 662 may simply support the light guide plate 64 so that the light guide plate 64 that is expanded and contracted is effectively supported. In addition, the second spacers 661 disposed at the rear side may support each of a rear surface of the heat insulation panel 652 and a front surface of the rear panel 651. Here, the second spacer 661, the insulation panel 652, and the rear panel 651 may completely adhere to each other. Thus, an insulation space is defined between the rear panel 651 and the insulation panel 652. For example, the insulation space may be defined to be vacuumed or be defined by injecting an insulating gas.

In the state in which the rear panel 651 adheres to the second spacer 66, an outer end of the rear panel 651 may further extend outward from the second spacer 66. Also, the outer frame 67 may be mounted on the outer end of the rear panel 651 so that the rear panel 651 and the front panel 61 are fixed to each other.

The outer frame 67 may have a rectangular frame shape. The outer frame 67 may connect the rear surface of the front panel 61 to the front surface of the rear panel 651. The outer frame 67 may define the peripheral surface of the panel assembly 60.

In detail, the outer frame 67 may define a periphery of an outer portion of the panel assembly 60 and also have a connection structure that is capable of allowing the front panel 61 to be maintained at a certain distance. The outer frame 67 may include a pair of side parts 671 defining both left and right surfaces and upper and lower parts, which connect upper and lower ends of the side part 671 to each other and define top and bottom surfaces, respectively.

A space between the front panel 61 and the rear panel 651, i.e., an inner space of the outer frame 67 may be completely sealed by the coupling of the outer frame 67. Also, the inside of the outer frame 67 may be more sealed by a sealant 68 (see FIG. 21) applied on a circumference of the outer frame 67.

That is, the overall outer appearance of the panel assembly 60 may be defined by the front panel 61, the rear panel 651, and the outer frame 67, and all of the remaining constituents may be provided in the outer frame 67. Thus, the sealing may be performed only between the outer frame 67, the front panel 61, and the rear panel 651 to completely seal the multilayered panel structure.

As a result, the panel assembly 60 may be disposed in the sub-door 50 so that the inside of the refrigerator is seen, and the screen is outputted, and also, the thermal insulation structure may be achieved in the multilayered panel structure at the minimum sealing point to secure the thermal insulation performance.

At least one display light 641 may be mounted on inner surface of the outer frame 67, preferably on the upper part 672 and/or the lower part 673. The one or more display lights 641 may be mounted on the upper part 672 and/or the lower part 673, respectively. The light guide plate 64 may be disposed between the display lights 641.

Thus, light emitted by the one or more display lights 641, preferably by an LED 641*a* of the display light 641 may be directed to an end of the light guide plate 64 and then travel along the light guide plate 64 so that the entire surface of the light guide plate 64 emits light.

The one or more display lights 641 disposed on the inner upper ends and/or inner lower ends of the panel assembly 60 may be connected to a light cable 642. The light cable 642 may have a flexible and flat shape like the touch cable 621 and the display cable 632.

The light cable 642 may be connected to the display light 641 that is mounted inside the outer frame 67 to extend to the outside of the panel assembly 60.

Also, the light cable 642 may extend along the circumference of the first display 63 so that the light cable 642 is not exposed through the first display 63. Also, the light cable 642 may extend upward in a state of being closely attached to the rear surface of the rear panel 651. As occasion demands, the display light cable 606 may be bent in the state of adhering to the rear surface of the rear panel 651 and then may be connected to a PCB 573 disposed on the upper portion of the sub-door 50.

Also, the sealant 68 may allow at least one of cables 601, 605, and 606 connected to the touch screen 62, the display panel 63, and the display light 641 within the panel assembly 60 to be accessible therethrough. That is, the sealant 68 may seal a portion that is in contact with an outer surface of each of the cables 621, 632, 642 when the cables 621, 632, 642 extend from the inside to the outside of the panel assembly 60 to prevent water or moisture from being introduced into a space through which the cables 621, 632, 642 are accessible.

A heater 675 may be disposed along an outer surface of the outer frame 67. The heater 675 may have a wire shape and be mounted on a heater mounting part 672*c* recessed along the outer surface of the outer frame 67. Heat generated by the heater 675 may heat the circumference of the front panel 61 along the outer frame 67 to prevent condensation from occurring.

Also, a panel assembly fixing part 672*b* may be disposed on the outer surface of the outer frame 67. A screw passing through the frame 70 may be coupled to the panel assembly fixing part 672*b*. The panel assembly 60 may be maintained in a state of being mounted on the frame 70 by the coupling of the screw.

Hereinafter, the structure of the frame 70 will be described in more detail with reference to the drawings.

Figure 12:
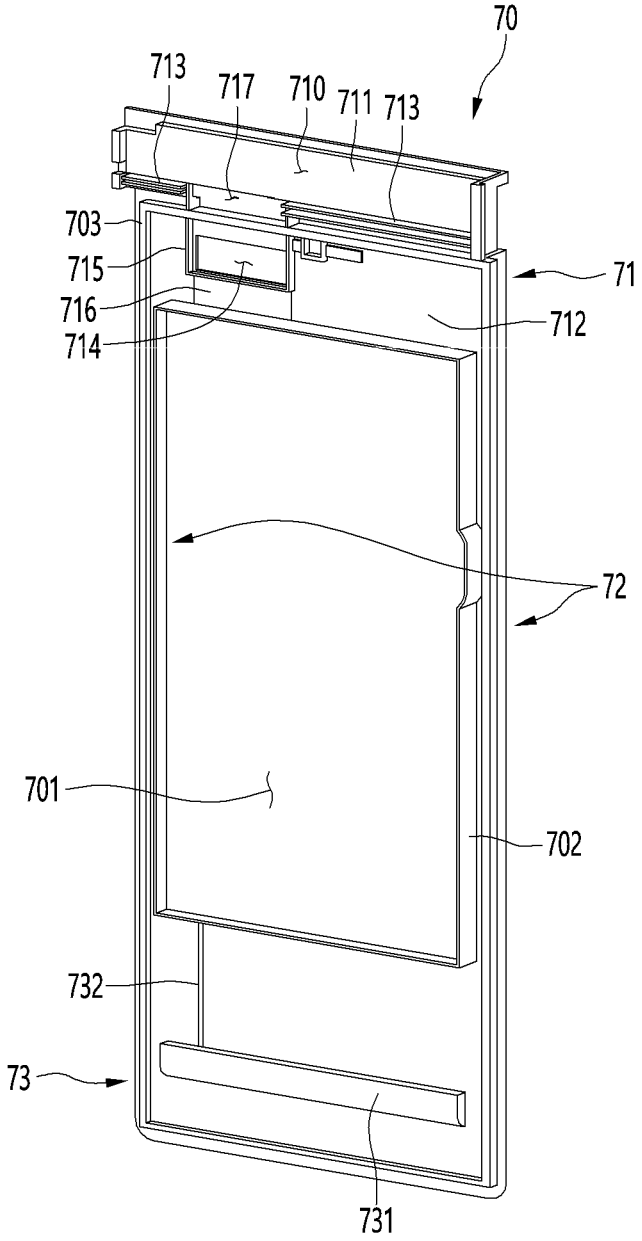
FIG. 12 is a rear perspective view of the support frame that is one component of the sub-door.

FIG. 11 is a front perspective view of a support frame that is one component of the sub-door. Also, FIG. 12 is a rear perspective view of the support frame that is one component of the sub-door.

As illustrated in the drawings, the frame 70 may be injection-molded using a plastic material and may have a rectangular frame shape so that a frame opening 701 is defined at a center thereof. Also, the frame 70 may have a predetermined width and be coupled to the outer plate 51, and simultaneously, the panel assembly 60 may be fixedly mounted on the frame 70.

The frame 70 may include an upper frame 71 defining an upper portion, a lower frame 73 defining a lower portion, and a side frame 72 connecting both ends of each of the upper frame 71 and the lower frame 73 to each other.

In detail, the frame 70 may define the overall shape of the frame 70 having the rectangular frame shape by coupling the upper frame 71, the lower frame 73, and the pair of side frames 72 to each other.

The upper frame 71 may support an upper portion of the outer plate 51 and an upper portion of the front panel 61. The upper frame 71 may define a shape of the upper portion of the frame 70 and may divide the upper space of the door 20, preferably sub-door 50 in a front and rear direction. That is, the upper frame 71 may be provided with an upper extension part 711 extending up to the top surface of the door 20, preferably sub-door 50, and the space above the sub-door 50 may be divided forward and backward by the upper extension part 711.

Thus, the upper side of the door 20, preferably sub-door 50 may be divided forward and backward by the upper frame 71.

A PCB accommodating space 710 in which the PCB 573 may be accommodated may be defined in a rear space. The PCB accommodating space 710 may communicate with the decoration opening 541.

The lower frame 73 may be coupled to a lower end of the side frame 72 and may be configured to support a lower portion of the outer plate 51 and a lower portion of the panel assembly 60.

The side frame 72 may define both left and right sides of the frame 70 and extend lengthily in a vertical direction to connect the upper frame 71 to the lower frame 73. That is, the side frame 72 has a structure that is capable of being coupled to both ends of the upper frame 71 and the lower frame 73.

The overall structure of the frame 70 may have the rectangular frame shape. The upper frame 71, the lower frame 73, and the side frame 72 are coupled to each other. In a state in which the frame 70 is assembled, a first mounting portion 702 extending backward from the frame 70, in particular from the first mounting part 712 may be disposed on a circumferential surface of the frame opening 701 defined at the center of the frame 70.

The first mounting portion 702 may extends backward to have a predetermined width and may be disposed to be in contact with the circumferential surface of the panel assembly 60, that is, the outer frame 67. Also, the screw that is coupled to pass through the first mounting portion 702 may be coupled to the outer frame 67 so that the panel assembly 60 is stably fixed and mounted on the frame 70.

A plate accommodating groove 703 recessed along a circumference of the frame 70 may be disposed on a front surface of the frame 70. The plate accommodating groove 703 may be recessed at a position corresponding to the bent plate part 512 so that the bent plate part 512 of the outer plate 51 is inserted and may be disposed along the bent plate part 512. In addition, the bent plate part 512 may be disposed to be in contact with the circumference of the front panel 61 in the state of being inserted into the plate accommodating groove 703.

Inner and outer surfaces of the plate accommodating groove 703 may define a plane having the same height, and thus, the front circumference of the frame 70 may stably support the rear surface of the outer plate 51 corresponding to the circumferential surface of the plate opening 511. That is, each of the upper frame 71, the lower frame 73, and the pair of side frames 72 may support the outer plate 51.

In this embodiment, the frame 70 may have a structure in which the frame 70 is molded to be separated into four parts, but the frame 70 may be provided by coupling two or more components to each other, as necessary.

The lower frame 73 may have a structure that supports and fixes the outer plate 51 and the lower portion of the panel assembly 60, and also, may be provided with a second mounting part 731 on which a second display 90 that allows light to be irradiated through the transmission part 612 is mounted. For example, the second display 90 may be configured so that a plurality of LEDs are arranged in a line along a substrate at a position corresponding to the transmission part 612. Thus, the second display 90 may be referred to as a line display or an LED bar. Also, the second display 90 may be referred to as an auxiliary display 90 so as to be distinguished from the first display 63.

Also, the upper frame 71 may define a space above the sub-door 50 in addition to the structure that supports and fixes the upper portion of the outer plate 51 and the panel assembly 60. In addition, the upper frame 71 may be configured to guide the cable 621 extending from the panel assembly 60.

Hereinafter the structure of the upper frame 71 will be described in more detail with reference to the drawings.

Figure 13:
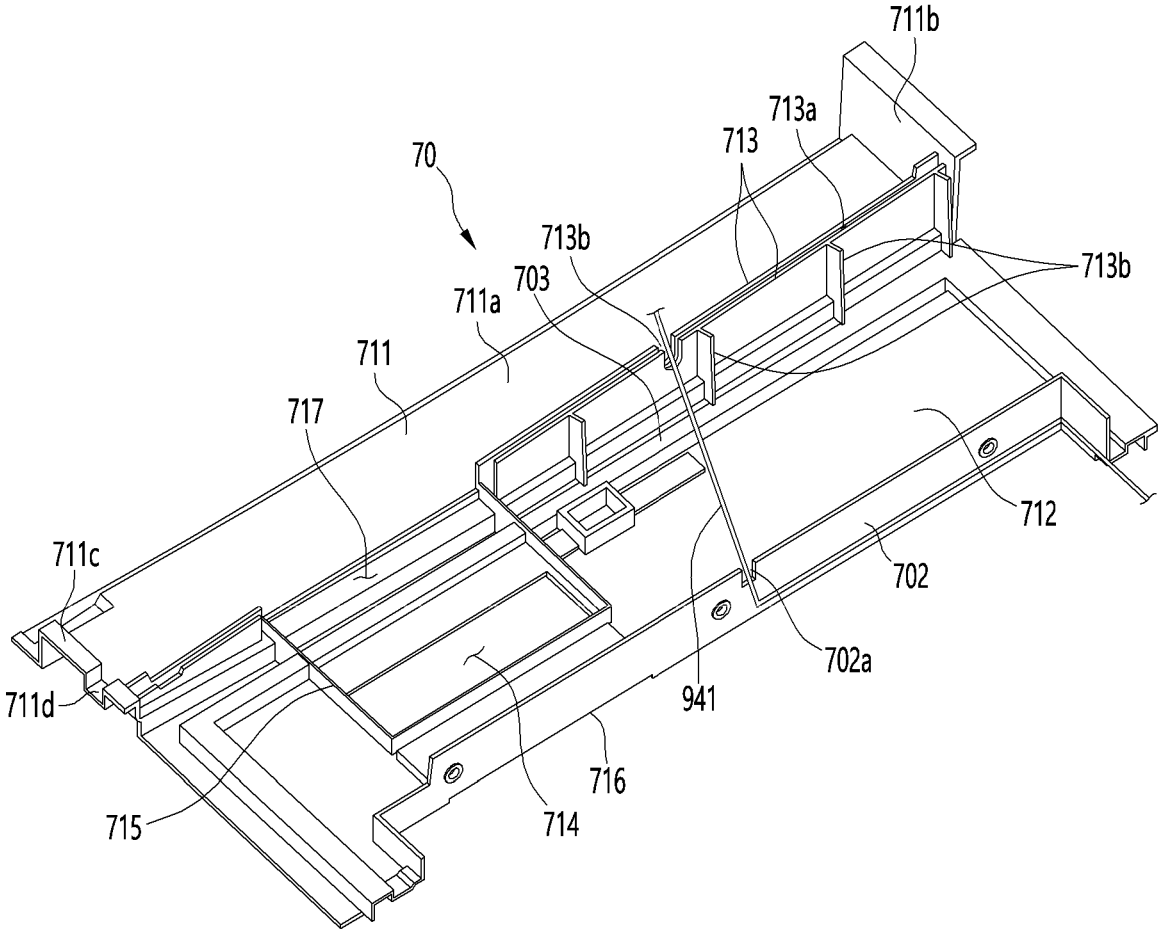
FIG. 13 is a rear perspective view illustrating the upper frame of the support frame.

FIG. 13 is a rear perspective view illustrating the upper frame of the support frame.

As illustrated in the drawings, the upper frame 71 may include an upper extension part 711 disposed at an upper side, a first mounting part 712 disposed at a lower side, and a barrier 713 disposed between the upper extension part 711 and the first mounting part 712.

In detail, the frame 70 may be divided by the barrier 713 into an upper portion and a lower portion. The first mounting part 712 may have a structure coupled to the outer plate 51 and the upper end of the panel assembly 60. The upper extension part 711 defines the PCB accommodating space 710, in which the PCB 573 or other components may disposed, in the upper end of the door 20, preferably the upper end of the sub-door 50. The barrier 713 may divide the first mounting part 712 and the upper extension part 711. The barrier 713 may define a bottom surface of the PCB accommodating space 710 to prevent the insulator 53 filled into the door 20, preferably sub-door 50, from being introduced into the PCB accommodating space 710.

In detail with reference to the structure of the first mounting part 712, an upper end of the frame opening 701 and a portion of the first mounting portion 702 may be disposed on a lower end of the first mounting part 712. Also, both side ends of the bottom surface of the first mounting part 712 may be configured to be coupled to the upper end of the side frame 72. In addition, the plate accommodating groove 703 may be defined in the first mounting part 712. The plate accommodating groove 703 may be disposed along a circumference of the first mounting part 712.

The first mounting part 712 may have a structure that allows the cable 621 to be guided from the upper end of the panel assembly 60 to the PCB accommodating space 710.

In detail, a guide wall 715 protruding backward to define a cable accommodating space, into which the insulator 53 is not introduced, may be disposed on the rear surface of the first mounting part 712. The guide wall 715 may have a rib shape having a predetermined thickness and may extend downward from the barrier 713.

The guide wall 715 may be disposed to be coupled to the frame cover 80 to be described below and may protrude to a height that is capable of being inserted into the frame cover 80. A lower end of the guide wall 715 may be spaced apart from the first mounting portion 702 and may provide a space in which the frame cover 80 is mounted in the first mounting part 712.

A cable inlet 714 may be disposed inside the guide wall 715. The cable inlet 714 may be opened to pass through the first mounting part 712 inside the guide wall 715.

A cable guide part 716 extending up to an upper end of the panel assembly 60 may be disposed at a lower end of the cable inlet 714. The cable guide part 716 may be recessed from the front surface of the first mounting part 712, and a recessed depth of the cable guide part 716 may correspond to the thickness of the cable 621 or be somewhat greater than the thickness of the cable 621. Thus, even if the front panel 61 is mounted on the frame 70, a passage in which the cable 621 is capable of being disposed may be provided between the front panel 61 and the frame 70 by the cable guide part 716. Thus, in the state in which the sub-door 50 is assembled, the cable 621 extending from a top end of the panel assembly 60 may pass through the cable guide part 716 and may be guided to an inner space of the guide wall 715 through the cable inlet 714.

In addition, a microphone mounting part 718 on which a microphone (not shown) that receives a user's voice signal may be disposed at a center of an upper portion of the first mounting part 712. In addition, a ground hole 719 through which a wire for grounding is connected may be defined in an upper portion of the first mounting part 712 by opening a portion of the plate accommodating groove 703. The wire for the grounding may be connected to a portion of the bent plate part 512 protruding through the ground hole 719.

Wire guide parts 702*a*, 713*b*, and 732 may be disposed in the frame 70. The wire 941 of the second display 90 mounted on the frame 70 may be guided to the PCB accommodating space 710 by the wire guide parts 702*a*, 713*b*, and 732 without being in direct contact with the insulator 53. Here, the wire 941 may have a wire shape unlike the cable 621.

That is, the cables 621, 632, and 642 each of which has a flat shape and which are connected to the panel assembly 60 may be guided into the PCB accommodating space 710 through a cable accommodating space defined by coupling of the frame 70 and the frame cover 80, and the wires 941 each of which has a wire shape and which are connected to other electric components including the second display 90 may be guided into the PCB accommodating space 710 along the wire guide parts 702*a*, 713*b*, and 732 provided in the frame 70.

The wire guide parts 702*a*, 713*b*, and 732 may include a barrier wire guide part 713*b* provided in the barrier 713, a mounting part wire guide part 702*a* provided in the first mounting portion 702, and a lower wire guide part 732 provided in the lower frame 73.

In detail, the barrier wire guide part 713*b* may be provided in the barrier 713. The wire 941 connected to the second display 90 may pass through the barrier wire guide part 713*b*. The barrier wire guide part 713*b* may be disposed at a position corresponding to a central area of the frame 70 in the horizontal direction. The barrier wire guide part 713*b* may be recessed from a protruding end of the barrier 713 or may pass through the barrier 713.

Also, a mounting part wire guide part 702*a* may be provided below the barrier wire guide part 713*b*. The mounting part wire guide part 702*a* may be provided on the first mounting portion 702. The mounting part wire guide part 702*a* may be configured so that the wire 941 guided between the first mounting portion 702 and a circumferential surface of the panel assembly 60 faces the barrier wire guide part 713*b* and may be disposed vertically below the barrier wire guide part 713*b*. In addition, the mounting part wire guide part 702*a* may be recessed from a protruding end of the first mounting portion 702 or may pass through the first mounting portion 702.

The microphone and the wire for the grounding may also have to be accessible to the inside of the PCB accommodating space 710 and may pass through the barrier wire guide part 713*b* provided in the barrier 713.

The cable accommodating space 810 defined by the guide wall 715 may be opened upward, and the opened top surface of the cable accommodating space 810 may be defined by a barrier opening 717. The barrier opening 717 may provide an inlet configured to so that the cable 621 is inserted into the space formed by the guide wall 715 is guided to the PCB accommodating space 710 and may be provided by cutting a portion of the barrier 713. Also, the barrier opening 717 may be referred to as a cable outlet because the cable 621 is guided to the outside of the cable accommodating space 810.

The barrier 713 may cross the upper frame 71 in the horizontal direction. Also, the barrier 713 may protrude vertically from a rear surface of the upper frame 71.

The sub-door 50 may have a thickness that gradually increase from one end, to which a rotation axis of the sub hinge is coupled, to the other end thereof. Thus, the barrier 713 may have a protruding height that gradually increases as it extends from one end to the other end to correspond to the thickness of the sub-door 50.

The barrier 713 may have the form of a pair of plates spaced apart from each other in the vertical direction. Thus, a barrier coupling groove 713*a* may be defined by the barrier 713. The barrier coupling groove 713*a* may be provided so that a liner coupling part 524 protruding from the front surface of the door liner 52 is inserted. Thus, when the door liner 52 is assembled, the liner coupling part 524 protruding in a rib shape at a position corresponding to the barrier coupling groove 713*a* may be inserted into the barrier coupling groove 713*a*. The inside of the sub-door 50 may be divided vertically with respect to the barrier 713 by the coupling of the door liner 52, and a foam liquid filled in the sub-door 50 may not be introduced above the barrier 713, i.e., into the PCB accommodating space 710.

A barrier reinforcement rib 713*c* may be disposed on the lower barrier 713 of the pair of barriers 713. The barrier reinforcement rib 713*c* may extend from the rear surface of the frame 70 in the protruding direction of the barrier 713. Here, the barrier reinforcement rib 713*c* may extend up to an end of the barrier 713. Also, the barrier 713 may protrude downward by a predetermined height with respect to a bottom surface of the barrier 713. When a plurality of the barrier reinforcement ribs 713*c* are provided at regular intervals, and the foam liquid is injected to form the insulator 53, the barrier 713 may be prevented from being deformed or damaged by an injection pressure of the foam liquid.

The barrier opening 717 may be defined in the barrier 713. The barrier opening 717 may pass through the barrier 713 vertically to communicate with a top surface of the cable accommodating space 810. That is, the barrier opening 717 may be provided to be opened by cutting a portion of the barrier 713. Also, the barrier 713 may extend at each of both left and right ends with respect to the barrier opening 717.

The upper extension part 711 may extends upward from the upper end of the barrier 713 to extend up to the top surface of the sub-door 50, that is, a bottom surface of the upper cap decoration 54. The upper extension part 711 may extend upward to define the PCB accommodating space 710. Also, side portions 711*b* and 711*c* defining both left and right surfaces of the PCB accommodating space 710 may be further disposed on both left and right sides of the upper extension part 711. A side hole 711*d* may be defined in each of the side portions 711*c*, which is adjacent to the rotation axis of the sub-door 50, of the left and right side portions 711*b* and 711*c*. The side hole 711*d* may allow the wire cable connected to the PCB 573 to be guided to the outside of the sub-door 50 through the rotation axis of the sub hinge.

The upper extension part 711 may be spaced apart from a front surface of the outer plate 51, and the molded insulator 531 may be disposed in a space between the outer plate 51 and the upper extension part 711. The molded insulator 531 may be made of an insulation material. For example, the molded insulator 531 may be provided as a vacuum insulator having excellent insulating performance or may be made of the same material as the insulator 53.

Also, the molded insulator 531 may be molded with a size and shape corresponding to a size of the space between the outer plate 51 and the upper extension part 711. Thus, in the process of assembling the sub-door 50, the molded insulator 531 may be inserted and mounted between the outer plate 51 and the front surface of the upper extension part 711. Even if the PCB accommodating space 710 is defined in the top of the sub-door 50 by mounting the molded insulator 531, and the insulator 53 is not filled in the PCB accommodating space 710, dew condensation may be prevented from being generated on the front surface of the outer plate 51.

Hereinafter, a structure in which the second display 340 is mounted will now be described in more detail with reference to the accompanying drawings.

Figure 14:
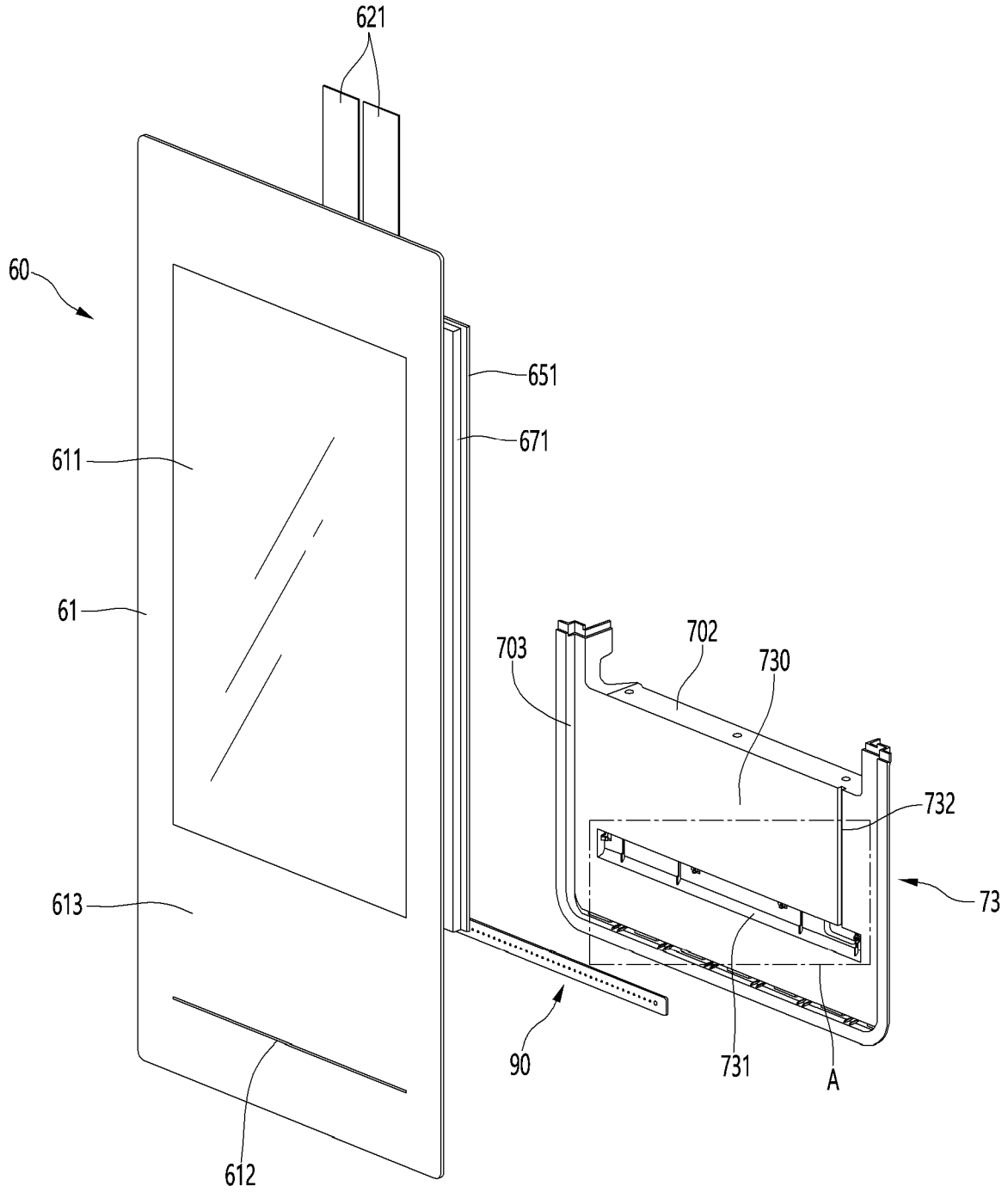
FIG. 14 is an exploded perspective view illustrating a coupling structure of the panel assembly, a second display, and a lower frame.
Figure 15:
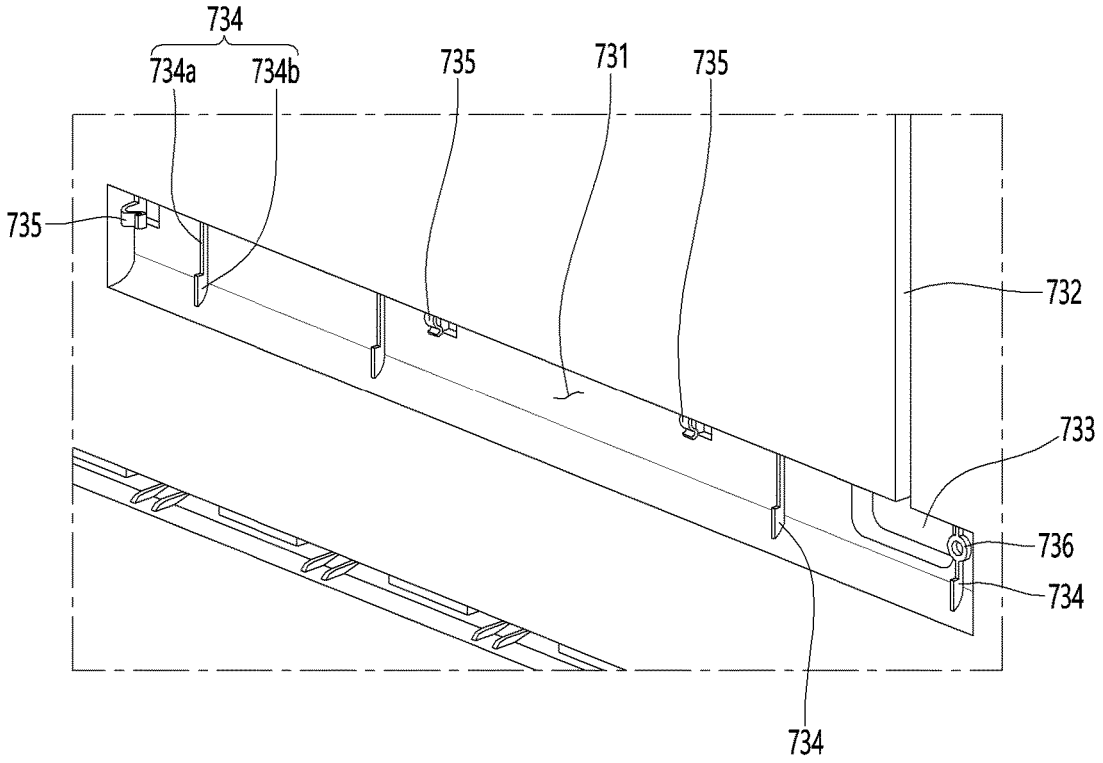
FIG. 15 is an enlarged view illustrating a portion A of FIG. 14.
Figure 16:
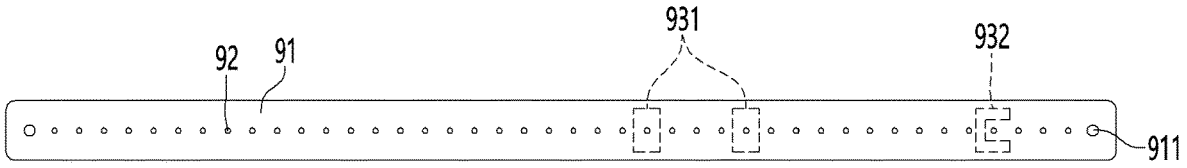
FIG. 16 is a front view of the second display.

FIG. 14 is an exploded perspective view illustrating a coupling structure of the panel assembly, a second display, and a lower frame. Also, FIG. 15 is an enlarged view illustrating a portion A of FIG. 14. Also, FIG. 16 is a front view of the second display.

As shown in the drawings, the lower frame 73 may be coupled to a lower end of the side frame 72. An upper end of each of both sides of the lower frame 73 may protrude upward and be coupled to the upper end of the side frame 72.

The upper end of the lower frame 73 may define a lower end of the frame opening 701 in a state of being coupled to the side frame 72. A first mounting portion 702 may be disposed along the frame opening 701. The first mounting portion 702 may be disposed along an entire circumference of the frame opening 701 and may be in contact with a circumferential surface of the panel assembly 60, i.e., the outer frame 70 and a sealant 68.

The lower frame 73 may generally include a front surface part 730 that is in contact with a rear surface of the front panel 61. The front part 730 may be in contact with the rear surface of the front panel 61 to support the panel assembly 60 at a rear side. Also, an adhesive may be applied to the front surface part 730, and the front panel 61 and the lower frame 73 may be firmly fixed by the adhesive.

A bent part accommodating groove 703 may be defined around the front surface part 730. The bent part accommodating groove 703 may be connected to the bent part accommodating groove 703 of the side frame 72 and the upper frame 70 and may be configured so that the bent plate part 512 of the outer plate 51 is inserted.

The outer plate 51 may be coupled to the lower frame 73 by inserting the bent plate part 512 into the inside of the bent part accommodating groove 703. Also, an outer end of the lower frame 73 outside the bent part accommodating groove 703 may be in contact with a rear surface of the outer plate 51 to support the outer plate 51 In the state in which the outer plate 51 is coupled to the lower frame 73, the bent plate part 512 may be in close contact with a circumferential surface of the front panel 61 seated on the lower frame 73. Thus, the front surface of the sub-door 50 in the assembled state may minimize a gap between an opening of the outer plate 51 and the front surface of the panel assembly 60.

A transmission part 612 may be disposed on an area of the bezel 613 under the front panel 61. The transmission part 612 may be disposed at a position corresponding to the second display 90 and be disposed in front of the second display 90. The transmission part 612 may be provided by cutting a portion of the bezel 613 to define a slit-shaped area through which light is transmitted. Thus, light irradiated from the second display 90 may pass through the transmission part 612 and be displayed to the outside.

As illustrated in FIG. 16, the second display 90 may include a substrate 91 and a plurality of LEDs 92 mounted on the substrate 91. The substrate 91 may have a size that is capable of being accommodated in the second mounting part 731 and may extend in a left and right direction.

Also, a plurality of the LEDs 92 may be continuously arranged at regular intervals along the substrate 91. Particularly, the arranged position of the LEDs 92 may correspond to the disposed position of the transmission part 612. Thus, a vertical width of the transmission part 612 may correspond to that of each of the LEDs 92. Also, the vertical width of the transmission part 612 may be less than that of the substrate 91.

In general, the substrate 91 may have a length greater than a horizontal length of the transmission part 612, and the LEDs 92 disposed at both ends among the LEDs 92 may be disposed at the same position as the transmission part 612 or disposed further inside the transmission part 612.

The LEDs 92 may be continuously disposed on a front surface of the substrate 91, and elements for controlling the LED 92 may be mounted on a rear surface of the substrate 91. Also, a substrate connector 932 to which the wire 941 for supplying power to the substrate 91 is connected may be provided at one side of the rear surface of the substrate 91. The substrate connector 932 may be disposed at a position adjacent to one end that is close to the lower wire guide part 732 so as to facilitate the connection with the wire 941 based on a center of the substrate 91.

Also, a screw hole 911 through which a screw 95 coupled to fix the substrate 91 pass may be defined in one end of the substrate 91. When the screw 95 is coupled to pass through the screw hole 911, the second display 90 may be fixed and mounted inside the second mounting part 731.

To mount the second display 90, a second mounting part 731 may be provided on the lower frame 73. The second mounting part 731 may be recessed to accommodate the second display 90. The second display 90 may be accommodated inside the second mounting part 731 and not interfere with the front panel 61 when the front panel 61 and the lower frame 73 are coupled to each other.

Also, the lower frame 73 may be provided with a lower wire guide part 732 connecting the second mounting part 731 to the frame opening 701. The lower wire guide part 732 may guide the wire 941 connected to the second display 90 from the second mounting part 731 to the inside of the frame opening 701.

The lower wire guide part 732 may have a size somewhat than a diameter of the wire 941 and may accommodate the wire 941 so that the wire 941 does not interfere with the front panel 61 in the state in which the front panel 61 is mounted on the lower frame 73. The lower frame 73 may be covered without being exposed forward by the bezel 613, and thus, the second display 90 and the wire 941 may not be exposed to the outside. However, light irradiated from the second display 90 may be transmitted to the outside through the transmission part 612.

In more detail with respect to the second mounting part 731 with reference to FIG. 15, the second mounting part 731 may be recessed in the front surface of the lower frame 73. The second mounting part 731 may have a size slightly greater than that of the substrate 91.

Also, a display support member 734 supporting the second display 90 at a rear side may be disposed inside the second mounting part 731. The display support member 734 may have a rib shape that protrudes forward from an inner surface of the second mounting part 731. Also, the display support member 734 may extend from an upper end to a lower end of the second mounting part 731. Thus, the second display 90 may be mounted inside the second mounting part 731 in a state of being spaced apart from an inner surface of the second mounting part 731.

In detail, the display support member 734 may include a rear support part 734*a* supporting the substrate 91 on the rear surface of the substrate 91 and a lower support part 734*b* supporting the substrate 91 at a lower end of the substrate 91. The rear support part 734*a* may have a length corresponding to a vertical width of the substrate 91 to support the substrate 91 at a rear side. Here, the substrate 91 may be spaced a protruding height of the rear support part 734*a* from the second mounting part 731. The element disposed on the rear surface of the substrate 91 and the substrate connector 932 may be prevented from interfering with the inner surface of the second mounting part 731 due to the spaced state of the substrate 91 by the rear support part 734*a*.

The lower support part 734*b* may further protrude forward from a lower end of the rear support part 734*a* to support the substrate 91 at the lower end of the substrate 91. Thus, the substrate 91 may maintain a set height and be maintained in a stably mounted state. Particularly, although a frequent impact is applied due to use characteristics of the sub-door 50 that is repeatedly opened and closed, the disposed position of the substrate 91 may be maintained.

A plurality of display support members 734 may be spaced apart from each other along a longitudinal direction of the second mounting part 731 and may be disposed inside the second mounting part 731 to stably support the substrate 91 as a whole.

A plurality of elastic fixing parts 735 may be disposed on the second mounting part 731. Each of the elastic fixing parts 735 may protrude inward from an outer end of the second mounting part 731 and press an end of the substrate 91 to fix the substrate 91.

In detail, the elastic fixing part 735 may be disposed more forward than the rear support part 734*a*. Also, the elastic fixing part 735 may be bent in a rounded shape to press the substrate 91, thereby fixing the substrate 91.

The elastic fixing part 735 may be provided in plurality to generally press the substrate 91 to be maintained in a state of being seated on the display support member 734 as a whole. For example, the elastic fixing part 735 may be disposed at one end of the left and right ends of the second mounting part 731 and may be disposed at a position opposite to one end to which the screw 95 is coupled. Also, a plurality of elastic fixing parts 735 may be disposed along an upper end of the second mounting part 731.

A coupling boss 736 to which the screw 95 passes through the substrate 91 is coupled may be disposed on one of the left and right sides of the second mounting part 731. For example, the coupling boss 736 may be integrated with the rear support part 734*a*. That is, the substrate 91 may be fixedly coupled in a state of being supported on the rear support part 734*a*.

Also, a connector recess 733 may be provided inside the second mounting part 731. The connector recess 733 may be defined in one of left and right sides with respect to a center of the second mounting part 731. In detail, the connector recess 733 may be defined in the same extension line as the lower wire guide part 732. The connector recess 733 may be further recessed than the second mounting part 731 and may have a size capable of accommodating the substrate connector 932 mounted on the substrate 91. Thus, when the substrate 91 is fixed and mounted on the display support member 734, the substrate connector 932 on the rear surface of the substrate 91 may be disposed at a position corresponding to the connector recess 733 so as not to interfere with the inner surface of the second mounting part 731.

The lower wire guide part 732 may guide the wire 941 connected to the second display 90 to be disposed and may extend upward from a position adjacent to the connector recess 733. In detail, the lower wire guide part 732 may extend vertically upward from an upper end of the second mounting part 731 and may extend to communicate with a lower end of the frame opening 701. The lower wire guide part 732 is opened forward, and thus, the wire 941 connected to the second display 90 in the state in which the second display 90 is mounted may be disposed on the lower wire guide part 732, and then, the panel assembly 60 may be mounted on the frame 70.

Hereinafter, a state in which the second display 90 is mounted, and an arrangement state of the wire 941 will be described in more detail with reference to the drawings.

Figure 17:
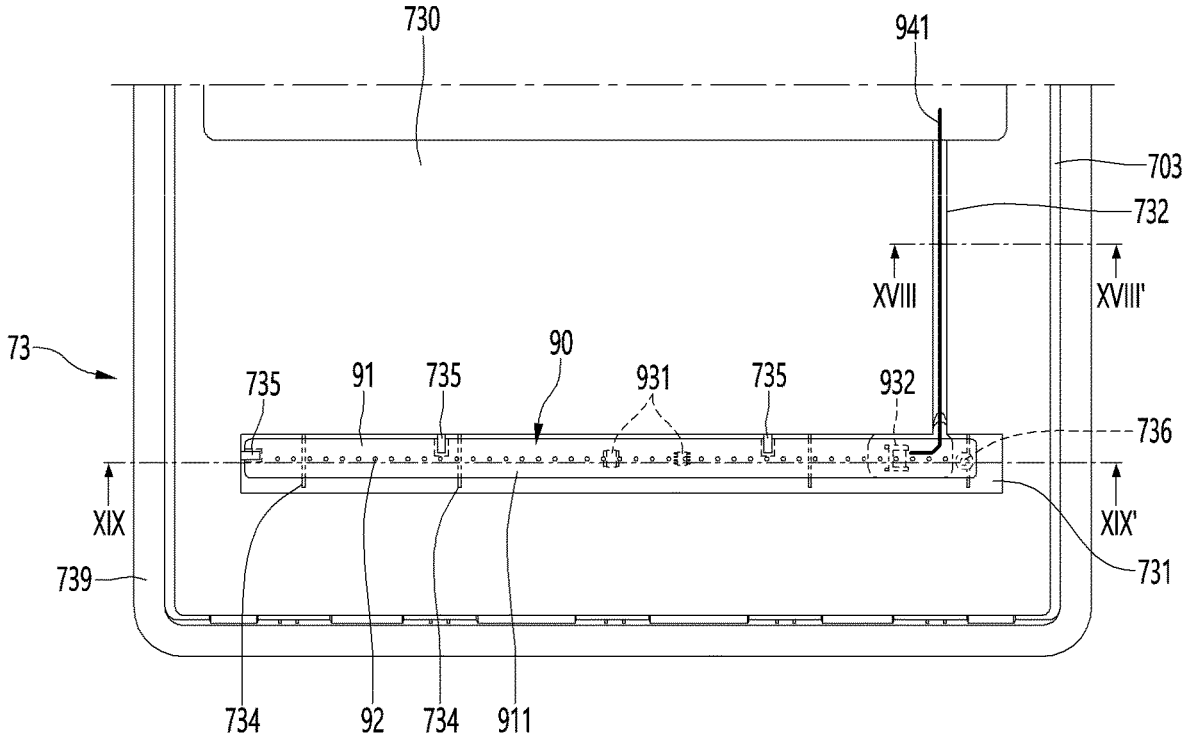
FIG. 17 is a front view illustrating a state in which the second display is mounted on the lower frame.
Figure 18:
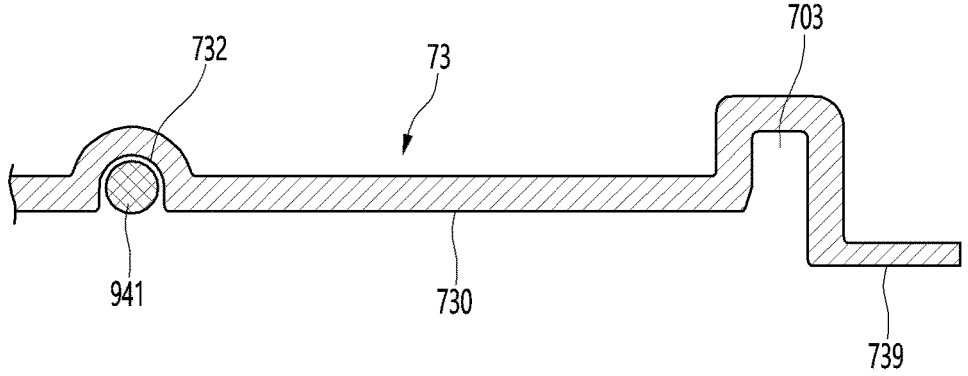
FIG. 18 is a cross-sectional view taken along line VIII-VIII' of FIG. 17.
Figure 19:
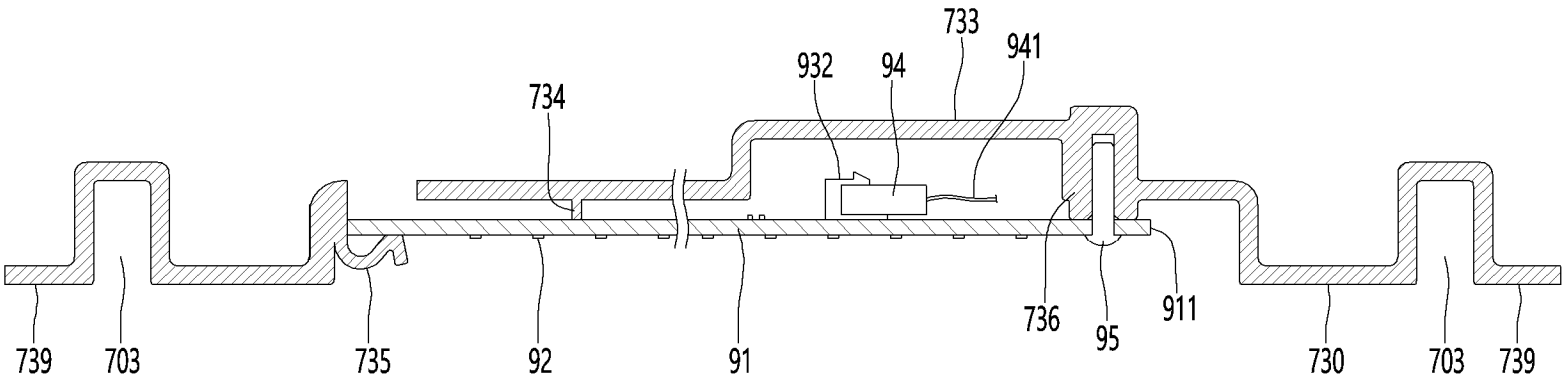
FIG. 19 is a cross-sectional view taken along line XIX-XIX' of FIG. 17.
Figure 20:
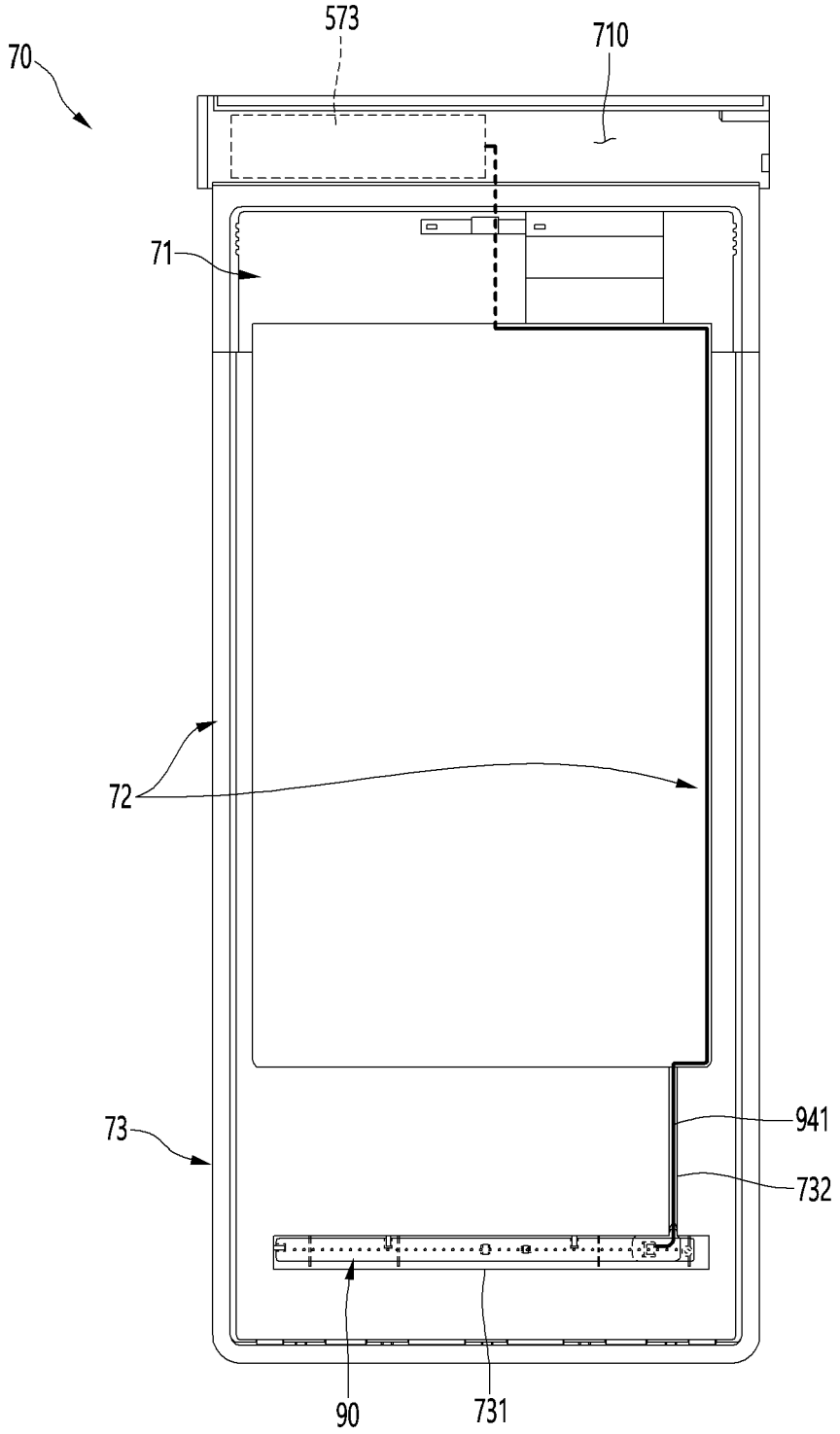
FIG. 20 is a view illustrating an arrangement of a wire between the second display and a PCB in the frame.

FIG. 17 is a front view illustrating a state in which the second display is mounted on the lower frame. Also, FIG. 18 is a cross-sectional view taken along line VIII-VIII' of FIG. 17. Also, FIG. 19 is a cross-sectional view taken along line XIX-XIX' of FIG. 17. Also, FIG. 20 is a view illustrating an arrangement of the wire between the second display and the PCB in the frame.

As shown in the drawings, the wire connector 94 may be coupled to the substrate connector 932 of the second display 90. The wire connector 94 may be connected to an end of the wire 941, and thus, the second display 90 may be connected to the wire 941 by coupling of the wire connector 94. Also, the second display 90 may be fixed and mounted on the second mounting part 731 in the state in which the wire 941 connected.

The second display 90 may be mounted on the display support member 734 and also be mounted so that the element 931 on the rear surface of the substrate 91 and the substrate connector 932 do not interfere with each other. Also, the second display 90 may not protrude further than the front surface part of the lower frame 73 so as not to interfere when the front panel 61 is mounted on the front surface part 730.

When the second display 90 is mounted, an upper end including one end of the left and right ends of the substrate 91 may be constrained by the elastic fixing part 735. Also, the lower end of the substrate 91 may be restricted by the lower end support 734*b* of the display support member 734. In addition, the screw 95 may pass through the screw hole 911 and be coupled and fixed to the coupling boss 736 at the other end of the left and right ends of the substrate 91.

Due to the fixing structure, the second display 90 may be firmly fixed to the second mounting part 731. Also, the second display 90 may be maintained in installation position in the sub-door 50 without being separated from the mounted position. That is, the arranged state of the LED 92 and the transmission part 612 may be maintained to secure a constant output of the screen when the second display 90 operates.

The wire 941 connected to the second display 90 may be escaped from the second mounting part 731 to extend upward along the lower wire guide part 732. The lower wire guide part 732 may be disposed along the front surface part 730 and be opened forward. Thus, the wire 941 may be disposed on the lower wire guide part 732 before assembling the panel assembly 60.

In detail, when the sub-door 50 is assembled, the second display 90 may be mounted on the second mounting part 731 of the lower frame 73, and simultaneously, the wire 941 connected to the second display 90 may also be disposed along the lower wire guide part 732.

Referring to FIG. 20, in the arrangement of the wire 941 in the frame 70, the wire 941 may be guided upward along the lower wire guide part 732. Since the wire 941 has a structure that is guided along the lower wire guide part 732, when the front panel 61 is seated on the front part 730 of the lower frame 73, the wire 941 may be naturally in an independent space. Thus, the wire may be guided upward through the independent space without being in contact with the insulator 53 filled in the sub-door 50.

Also, the wire 941 guided to the upper end of the lower wire guide part 732 reaches a lower end of the frame opening 701. The wire 941 may be guided upward along an inner wall of the frame opening 701, i.e., the first mounting portion 702.

Here, in the state in which the panel assembly 60 is mounted on the frame 70, the outer frame 70 and the sealant 68 may be in contact with the first mounting portion 702. Also, the wire 941 may be guided upward along a space between the outer frame 70 and the first mounting portion 702 or between the sealant 68 and the first mounting portion 702. Particularly, the sealant 68 may have elasticity, and thus, so even if a separate space is not defined, the wire 941 may be guided upward in a state of being sandwiched between the sealant 68 and the first mounting portion 702.

The wire 941 may be guided upward along the inner surface of the frame opening 701, i.e., the outer surface of the panel assembly 60. Also, the wire 941 may be guided along the upper end of the frame opening 701 or the upper end of the outer surface of the panel assembly 60, and when reaching a center of the frame opening 701, the wire 941 may move to the rear space of the frame 70 through the mounting part wire guide part 702*a*. In a section in which the wire 941 is guided along a circumference of the frame opening 701, the wire 941 may not be exposed to the space in which the insulator 53 is disposed, and the wire 941 may be disposed without separate wire restraint.

Also, the wire 941 guided upward through the mounting part wire guide part 702*a* may be introduced into the PCB accommodating space 710 through the barrier wire guide part 713*b*. The wire 941 introduced into the PCB accommodating space 710 may be connected to the PCB 573.

The wire 941 may be exposed to the space in which the insulator 53 is disposed in a region between the mounting part wire guide part 702*a* and the barrier wire guide part 713*b*. Here, a separate tape, sheet, or cover may be attached to the frame 70 to cover the wire 941 between the mounting part wire guide part 702*a* and the barrier wire guide part 713*b*, and thus, the entire wire 941 may not be exposed to the insulator 53.

Hereinafter, the operation of the second display 90 having the above structure will be described in detail with reference to the drawings.

Figure 21:
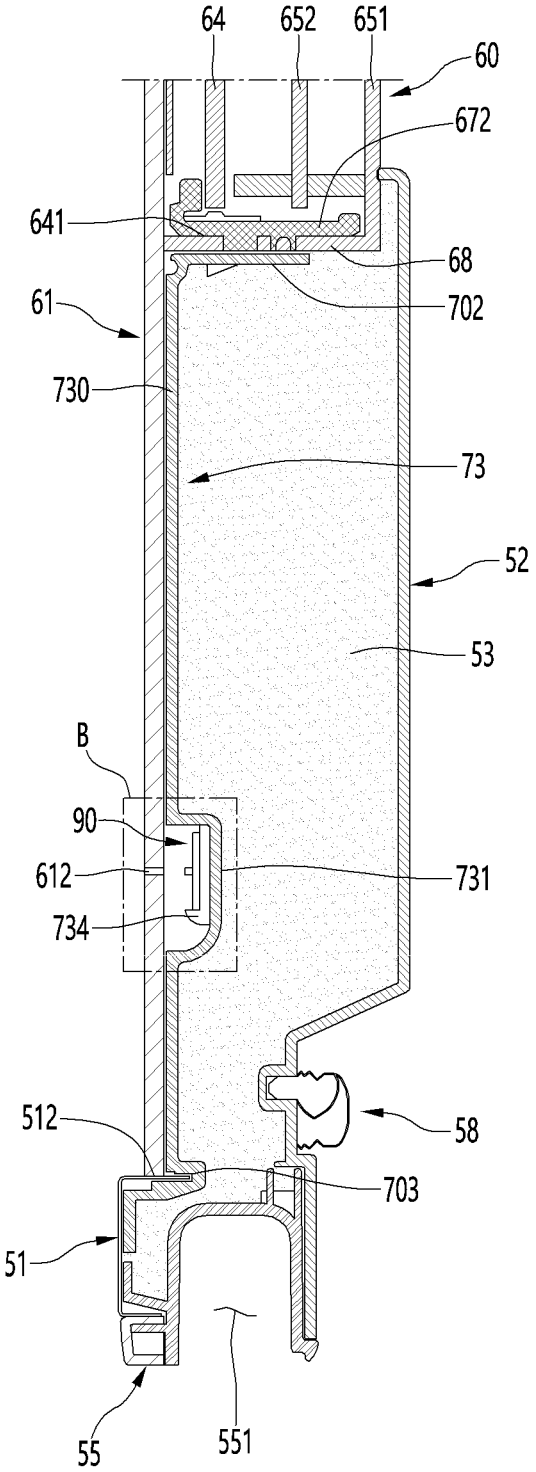
FIG. 21 is a cross-sectional view illustrating a lower end of a sub-door.
Figure 22:
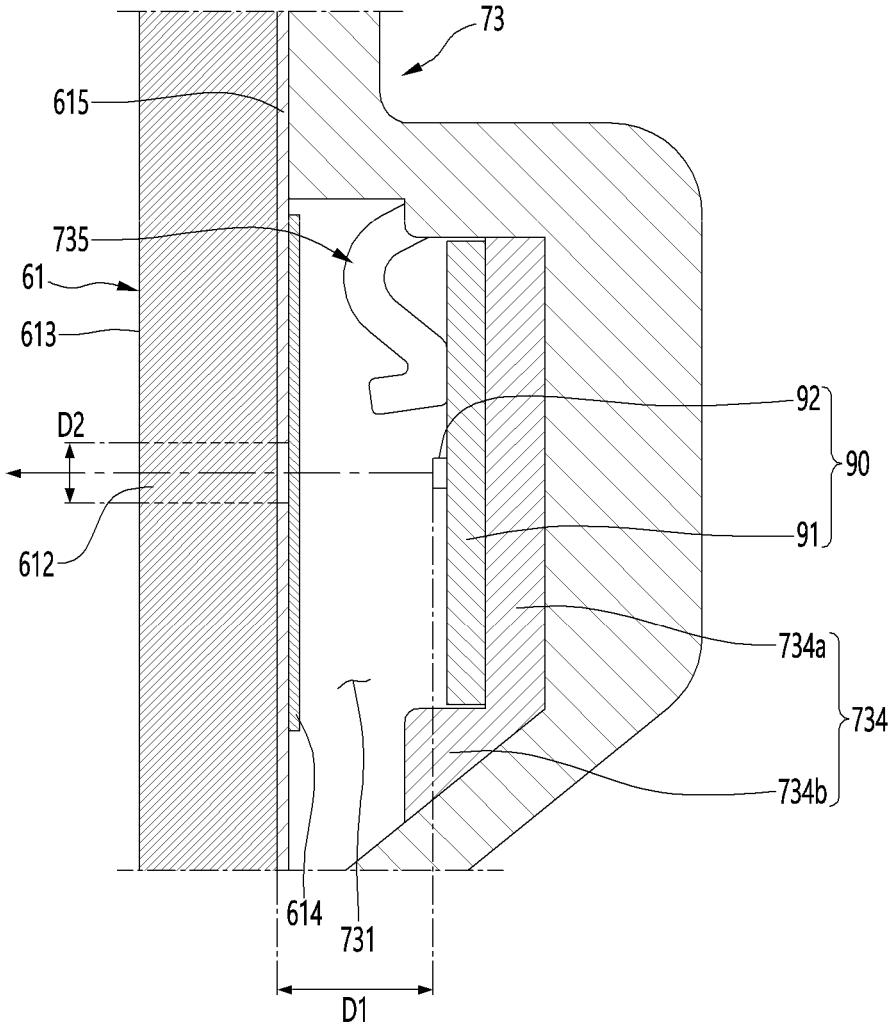
FIG. 22 is an enlarged view illustrating a portion B of FIG. 21.
Figure 23:
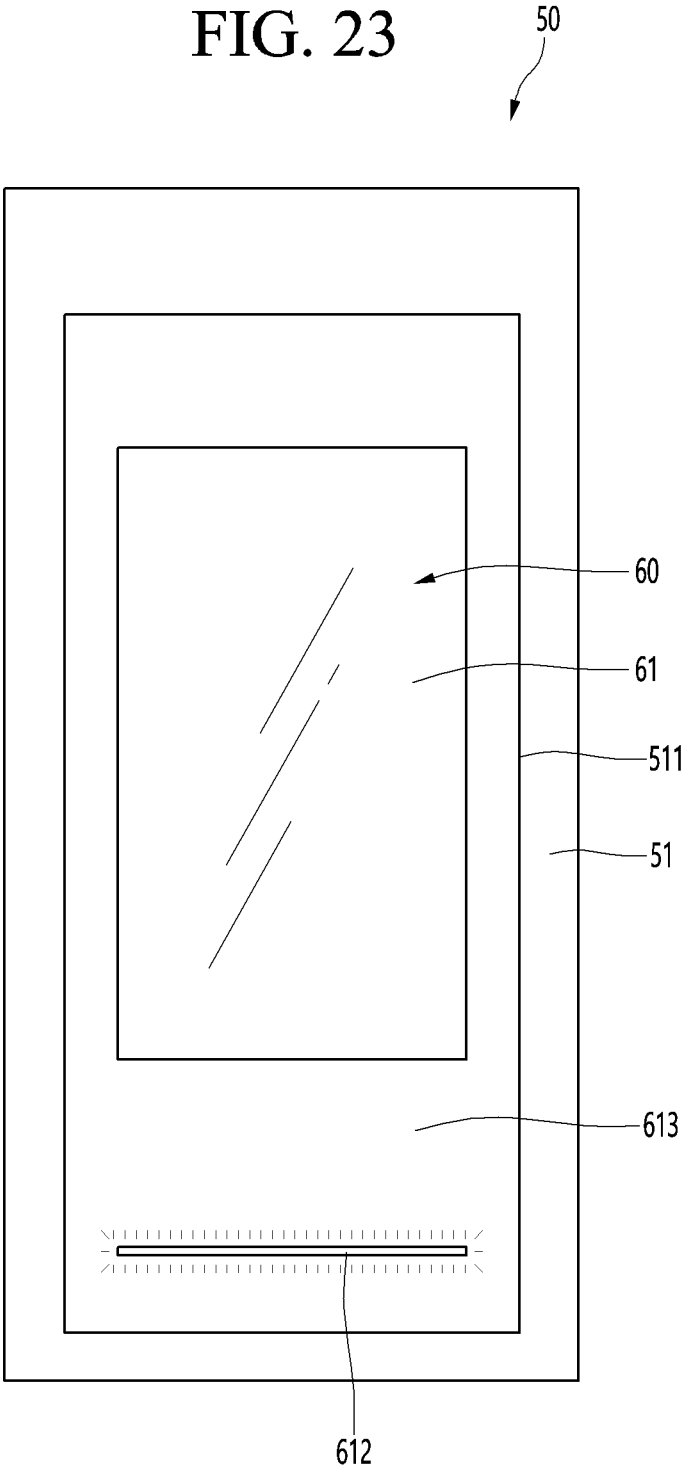
FIG. 23 is a view illustrating an output state of a transmission part in the sub-door.

FIG. 21 is a cross-sectional view illustrating the lower end of the sub-door. Also, FIG. 22 is an enlarged view illustrating a portion B of FIG. 21. Also, FIG. 23 is a view illustrating an output state of the transmission part in the sub-door.

As illustrated in the drawings, in the state in which the sub-door 50 is assembled, the second display 90 may operate at a position corresponding to the transmission part 612 When the LED 92 of the second display 90 is turned on, the light of the LED 92 may be seen to the outside through the transmission part 612.

A bezel layer 615 may be disposed on the rear surface of the front panel 61 to prevent the light irradiated from the LED 92 from being transmitted to a portion other than the transmission part 612. The bezel layer 615 may be configured to block transmission of light and prevent the rear side of the front panel 61 from being visible. For example, the bezel layer 615 may be printed with a black color or provided by attaching a film, and an area of the bezel 613 may be defined by the bezel layer 615. Thus, only the area of the transmission part 612 on which the bezel layer 615 is not formed may transmit the light irradiated from the LED 92.

Also, a diffusion sheet 614 may be attached to the rear surface of the front panel 61 corresponding to the transmission part 612. The diffusion sheet 614 may be configured to shield the transmission part 612 at the rear side. Thus, the light irradiated from the LED 92 may be transmitted through the diffusion sheet 614, and thus, the transmission part 612 may be illuminated in the form of an overall surface light. That is, the light may be prevented from being shined in the form of a spot due to light condensation at a position corresponding to the LED 92 in the transmission part 612. Particularly, in a situation in which an arranged distance of the LED 92 is not designed to exceed a set distance for thermal insulation of the sub-door 50, the transmission part 612 may be shined in the form of the surface light by attaching the diffusion sheet 614. That is, the second display 90 may be disposed at a position that is the farthest distance within a range in which the insulation of the sub-door 50 is satisfied.

For example, an arrangement distance D1 between the LED 92 and the rear surface of the front panel 61 may be about 5 mm to about 6 mm. Thus, the transmission part 612 may be illuminated in the form of the surface light without the light condensation due to the light passing through the diffusion sheet 614 while satisfying the thermal insulation of the sub-door 50.

Also, a vertical width D2 of the transmission part 612 may be about 2 mm. An extension line passing through a center of the transmission part 612 may be disposed at the same position as the extension line passing through the center of the LED 92. Also, the transmission part 612 may have the vertical width D2 of about 2 mm. Thus, shadowing does not occur in the vertical direction, and the entire transmission part 612 may be brightly shined. Thus, generally the arrangement distance D1 between the LED 92 and the rear surface of the front panel 61 may be larger than the vertical width D2 of the transmission part 612.

The transmission part 612 may be configured to be shined by the plurality of LEDs 92 and may be converted into various colors according to the operation of the LED 92. Thus, a specific color may be expressed according to an operation state of the refrigerator 1.

Also, the transmission part 612 may partially turn on and off the LED 92 so that only a portion of the entire light is illuminated, and the operation state of the refrigerator including a temperature and time may be displayed as a bar graph or a bar in which a length varies.

Also, the transmission part 612 may allow the LED 92 to be continuously turned on and off, thereby enabling a dynamic output. For example, the shining portion may be changed, or the length or color of the shining area may be continuously changed. Also, the transmission part 612 may operate in conjunction with other components constituting the refrigerator 1. For example, the first display 63 may be interlocked with the operation of the first display 63 so as to be output when the first display 63 outputs a specific screen, or the screen may be output in the state in which the first display 63 is turned off. Also, when the microphone operates, the transmission part 612 may be visualized.

Although the structure in which the panel assembly and the second display are provided in the sub-door is described in embodiments, the structure may be equally applied to a refrigerating compartment door provided as a single door.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising, a cabinet defining a storage space; and a door configured to open and close the storage space, wherein the door comprises:

a panel assembly including:

a front panel including a transparent material and defining a front surface of the door, a rear panel including a transparent material and being spaced apart from the front panel, and spacers disposed between the front panel and the rear panel and defining a first space, the first space configured to receive an insulating gas or maintain a vacuum state, a door liner defining a rear surface of the door and having a door liner opening that coupled to the rear panel, cap decorations defining upper and lower surfaces of the door and coupled to the door liner, an insulator disposed within a second space, the second space being defined by the panel assembly, the door liner, and the cap decorations, a frame disposed within the second space and having a front surface part that contacts a rear surface of the front panel, a mounting part that is recessed from the front surface part and configured to provide a third space that separated from the second space, a display mounted at the mounting part and spaced apart from the front panel within the third space, and a diffusion sheet attached to the rear surface of the front panel and facing the display, wherein the front panel includes:

a see-through part disposed at a position corresponding to the door liner opening, the see-through part being configured to permit an inside of the refrigerator to be visible through the door liner opening, a transmission part spaced apart from the see-through part and facing the display, the transmission part being configured to transmit light of the display, the transmission part defining a slit-shaped area, and an opaque bezel surrounding the see-through part and the transmission part, and wherein the display includes a plurality of light emitting diodes (LEDs) arranged along a longitudinal direction of the transmission part.

2. The refrigerator of claim 1, wherein the plurality of LEDs are spaced apart from the rear surface of the front panel by a first distance, and the transmission part is configured to illuminate free of a light condensation based on the light passing through the diffusion sheet.

3. The refrigerator of claim 2, wherein a first vertical width of the transmission part is less than the first distance.

4. The refrigerator of claim 3, wherein each of the plurality of LEDs has a second vertical width that is less than the first vertical width of the transmission part to thereby dispose the plurality of LEDs within the transmission part.

5. The refrigerator of claim 1, further comprising a controller configured to control an operation of the plurality of LEDs, wherein the controller is configured to control the plurality of LEDs to illuminate a first portion of the transmission part in a first color and illuminate a second portion of the transmission part in a second color.

6. The refrigerator of claim 1, further comprising a controller configured to control an operation of the plurality of LEDs, wherein the controller is configured to control the plurality of LEDs to partially turn on and off, thereby illuminating a first portion of the transmission part and not illuminating a second portion of the transmission part.

7. The refrigerator of claim 1, wherein the panel assembly further comprises a transparent display provided within the first space, and wherein the transparent display is transparent to enable the storage space to be visible from an outside of the panel assembly.

8. The refrigerator of claim 7, wherein the panel assembly further comprises:

a light guide plate provided within the first space; and a display light configured to irradiate light to the light guide plate.

9. The refrigerator of claim 8, wherein the spacers comprise:

a first spacer provided between the transparent display and the light guide plate; and a second spacer provided between the light guide plate and the rear panel.

10. The refrigerator of claim 8, wherein the panel assembly is configured to be in a plurality of mode states, the plurality of mode states comprising:

a transparent mode state in which a lighting module is turned on to allow the storage space to be visible through the panel assembly and the display light is turned off to not output screen information, an opaque mode state in which the lighting module is turned off to make the storage space to be invisible through the panel assembly and the display light is turned off to not output the screen information, and a screen output mode state in which the lighting module is turned off and the display light is turned on, the display being configured to output the screen information through the panel assembly.

11. The refrigerator of claim 7, wherein the display is configured to, based on the transparent display being turned off, turn on and display information by light transmitted from the plurality of LEDs.

12. The refrigerator of claim 1, wherein the frame includes:

an upper frame defining an upper portion, a lower frame defining a lower portion, and a side frame connecting an end of the upper frame to an end of the lower frame, and wherein the mounting part is provided at the lower frame.

13. The refrigerator of claim 1, wherein the frame further comprises an additional mounting part, and wherein the additional mounting part passes through the front surface part of the frame and contacts a periphery of the panel assembly.

14. The refrigerator of claim 1, wherein the display further comprises a substrate having a first surface on which the plurality of LEDs are mounted, and wherein the refrigerator further comprises a support member provided at the mounting part and supporting a second surface of the substrate.

15. The refrigerator of claim 1, wherein the door comprises an outer plate providing a side surface of the door, the outer plate having a plate opening that couples the panel assembly.

16. The refrigerator of claim 1, wherein a size of the front panel is greater than a size of the rear panel, and the opaque bezel is disposed at the rear surface of the front panel.

17. The refrigerator of claim 1, further comprising a heater provided along an outer surface of the frame, and wherein the frame is configured to transfer heat generated by the heater to a circumference of the front panel to restrict condensation.

18. The refrigerator of claim 1, wherein the storage space is positioned at an upper portion of the cabinet, wherein the cabinet further comprises an additional storage space positioned at a lower portion of the cabinet, and wherein the refrigerator further comprises an additional door configured to open and close at least a portion of the additional storage space.

19. The refrigerator of claim 1, wherein the door comprises a first door and a second door that are configured to open and close the storage space, wherein the first door comprises a main door having a door opening and a sub-door to open and close the door opening, and wherein the panel assembly is mounted at the sub-door.

20. The refrigerator of claim 19, wherein the main door further comprises a door basket provided at a rear surface of the main door, and wherein the door basket defines an additional storage space of the main door.

* * * * *